US007486914B2

(12) United States Patent
Kabata et al.

(10) Patent No.: US 7,486,914 B2
(45) Date of Patent: Feb. 3, 2009

(54) ELECTROPHOTOGRAPHIC IMAGE FORMING APPARATUS, PROCESS CARTRIDGE AND IMAGE FORMING METHOD WHEREIN LUBRICANT IS SUPPLIED TO A SURFACE OF AN IMAGE BEARING MEMBER

(75) Inventors: Toshiyuki Kabata, Yokohama (JP); Keisuke Shimoyama, Numazu (JP); Hideo Nakamori, Numazu (JP); Shinji Nousho, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 246 days.

(21) Appl. No.: 11/444,198

(22) Filed: May 30, 2006

(65) Prior Publication Data

US 2006/0269323 A1 Nov. 30, 2006

(30) Foreign Application Priority Data

May 30, 2005 (JP) ..... 2005-157090
May 31, 2005 (JP) ..... 2005-158449

(51) Int. Cl.
*G03G 15/00* (2006.01)

(52) U.S. Cl. ..... 399/159; 399/346

(58) Field of Classification Search ..... 399/107, 399/111, 116, 159, 161, 162, 343, 346; 430/66, 430/67

See application file for complete search history.

(56) References Cited

U.S. PATENT DOCUMENTS 4,957,839 A 9/1990 Rokutanzono et al.
5,008,172 A 4/1991 Rokutanzono et al.
5,147,751 A 9/1992 Kojima et al.
5,342,718 A 8/1994 Nousho et al.
5,733,702 A * 3/1998 Okado et al. ..... 430/119.86
5,991,573 A 11/1999 Nohsho et al.
6,171,742 B1 * 1/2001 Kawada et al. ..... 430/67

(Continued)

FOREIGN PATENT DOCUMENTS

JP 01-170951 A 7/1989

(Continued)

OTHER PUBLICATIONS

Y. Kitazaki et al., Journal of Japan AdhesionSociety, 8(3), pp. 131-141 (1972).

*Primary Examiner*—Hoan H Tran
(74) *Attorney, Agent, or Firm*—Cooper & Dunham LLP

(57) ABSTRACT

An image forming apparatus including an image bearing member having a surface free energy of not less than 45 mN/m, a charging device for charging the image bearing member, an irradiating device for irradiating the image bearing member with light to form a latent electrostatic image thereon, a developing device for developing the latent electrostatic image with a toner optionally containing a lubricant, a transfer device for transferring the developed image to a transfer medium, a cleaning device for cleaning the surface of the image bearing member, and optionally a lubricant supplying device for supplying a lubricant to the surface of the image bearing member. A lubricant is supplied to the surface of the image bearing member by at least one of the toner and the lubricant supplying device so that the surface free energy on average in an image formation area on the image bearing member is not greater than 32 mN/m while the maximum difference of the surface free energy is not greater than 5 mN/m.

16 Claims, 15 Drawing Sheets

U.S. PATENT DOCUMENTS

| | | | | |
|---|---|---|---|---|
| 6,521,388 | B2 | 2/2003 | Kabata et al. | |
| 6,534,227 | B2 | 3/2003 | Kabata et al. | |
| 6,649,313 | B2 | 11/2003 | Kabata et al. | |
| 6,699,631 | B2 | 3/2004 | Miyamoto et al. | |
| 6,778,802 | B2 | 8/2004 | Kabata et al. | |
| 6,816,691 | B2 | 11/2004 | Kabata et al. | |
| 6,821,694 | B2 | 11/2004 | Kabata et al. | |
| 6,830,857 | B2 | 12/2004 | Kabata et al. | |
| 6,879,799 | B2 | 4/2005 | Nohsho et al. | |
| 7,043,175 | B2 * | 5/2006 | Komoto et al. | 399/159 |
| 7,171,152 | B2 * | 1/2007 | Akagi et al. | 399/356 |
| 2004/0151997 | A1 | 8/2004 | Miyamoto et al. | |
| 2005/0026058 | A1 | 2/2005 | Kami et al. | |
| 2005/0031377 | A1 | 2/2005 | Kabata et al. | |
| 2005/0053853 | A1 | 3/2005 | Sugino et al. | |
| 2005/0069357 | A1 | 3/2005 | Kabata et al. | |
| 2005/0118518 | A1 | 6/2005 | Ikegami et al. | |
| 2005/0141917 | A1 | 6/2005 | Enoki et al. | |
| 2005/0232658 | A1 | 10/2005 | Kabata et al. | |
| 2005/0276632 | A1 | 12/2005 | Ariizumi et al. | |
| 2006/0062595 | A1 | 3/2006 | Nousho et al. | |

FOREIGN PATENT DOCUMENTS

| | | | |
|---|---|---|---|
| JP | 10-069100 | A | 3/1998 |
| JP | 2859646 | B2 | 12/1998 |
| JP | 11-311875 | A | 11/1999 |
| JP | 2000-221769 | A | 8/2000 |
| JP | 2001-066812 | A | 3/2001 |
| JP | 2001-175014 | A | 6/2001 |
| JP | 2001-272809 | A | 10/2001 |
| JP | 2001-343773 | A | 12/2001 |
| JP | 2001-343862 | A | 12/2001 |
| JP | 2002-229241 | A | 8/2002 |
| JP | 2005-018047 | A | 1/2005 |

* cited by examiner

ELECTROPHOTOGRAPHIC IMAGE FORMING APPARATUS, PROCESS CARTRIDGE AND IMAGE FORMING METHOD WHEREIN LUBRICANT IS SUPPLIED TO A SURFACE OF AN IMAGE BEARING MEMBER

BACKGROUND OF THE INVENTION

1. Field of the Invention

The present invention relates to an image forming apparatus and a process cartridge.

2. Discussion of the Background

With the development and diffusion of home computers, the demand for improving the quality of color images produced by an electrophotographic image forming apparatus is extremely strong. There is nothing surprising for such a demand considering that materials containing color images taken by a digital camera or a scanner and half-tone colored plot areas for a graph are commonly used.

In addition, images taken by a digital camera can be also commonly developed not only in silver halide photography but also by a dye sublimation printer or an inkjet printer. However, these image formations take a long time and cost of paper and ink therefore is expensive. Therefore, to make a poster and a presentation material, the speed and cost of production cause problems.

The image formation using electrophotography is excellent in light of the production speed and cost but needs improvement on image quality. To improve the quality of images produced in the image formation using electrophotography, it is good to decrease the particle size of a toner. But, as the particle size of a toner decreases, cleaning performance by a cleaning blade for removing the toner remaining on an image bearing member becomes insufficient. As a result, the image quality significantly deteriorates. Since the amount of charge in a small toner particle per weight unit is large, the electrostatic force attracting the toner particle to an image bearing member increases. When a cleaning blade is used to scrape toner particles remaining on the image bearing member, the force of scraping small toner particles by the cleaning blade is relatively small in comparison with the case of scraping large toner particles since the contact portion between the small toner particles and the cleaning blade is correspondingly small. Further, small toner particles can slip through the cleaning blade since the friction between the image bearing member and the cleaning blade can cause the cleaning blade to vibrate. Consequently, the quality of images deteriorates. When a large amount of toner has slipped through the cleaning blade, the obtained resultant images may be abnormal images having streaks. In addition, such toner particles that slip past the leaning blade attach to a charging roller and make the resistance and voltage thereof uneven, which may result in the occurrence of white streaks in an obtained image.

To reduce the attraction force between toner particles and an image bearing member, it is effective to reduce the surface free energy of the image bearing member. For example, unexamined published Japanese patent application No. (hereinafter referred to as JOP) H10-69100 describes that an image bearing member having a surface free energy of not greater than 30 dyne/cm can be obtained by using a binder resin containing a fluorine resin. An image forming apparatus using this image bearing member can form quality images for a while but has a drawback that the surface free energy of the image bearing member increases over repetitive use, which leads to deterioration of the quality of obtained images.

JOP 2001-66812 describes an image forming apparatus using an image bearing member having a surface layer formed of amorphous silicon containing fluorine and a cleaning device which removes the material causing image flow which attaches to the surface of the image bearing member during repetitive image formation. The surface free energy of the image bearing member is restrained to be not greater than 40 mN/m. But since the surface layer of amorphous silicon containing fluorine is formed by a gas phase method, cost of the image bearing member is expensive. In addition, there is no specific description about the cleaning performance for removing the remaining toner on the image bearing member when small toner particles are used. In general, the cleaning performance deteriorates not in all the image formation area but in a limited part in a concentrated manner. This is ascribable to the form of a cleaning blade and variation of the surface free energy of an image bearing member. Therefore, it is not sufficient to measure the surface free energy of an image bearing member only at one point.

JOP 2001-272809 describes an image forming apparatus using an image bearing member having a siloxane based resin layer with a surface free energy of from 40 to 80 mN/m and a toner having an average particle diameter of from 4 to 12 μm and an average charging amount of from 10 to 30 μC/g. However, the toner for use in the image forming apparatus is set to have a low amount of charge on average to weaken the attraction force between the toner and the image bearing member. Thereby, the stability of the images obtained using this toner is relatively low in comparison with the case of when a typical toner is used. This is not preferred because the background fouling easily occurs depending on environment.

JOP H11-311875 describes an image forming apparatus using an image bearing member having a surface free energy of from 3 to 65 mN/m, in which the rise of the surface free energy is limited to 25 mN/m during the duration of the image bearing member. In the measurement of the surface free energy described in JOP H11-311875, three kinds of solvents, i.e., water, methylene iodide, and α-bromonaphthalene, are used. But it is not possible to evaluate the calculation error of the surface free energy when only three kinds of solvents are used. Water is especially vulnerable to measurement error and difficult to obtain the true surface free energy. In addition, as described above, it is not sufficient to measure the surface free energy at only one point on an image bearing member except when a user forms images totally at random. This is because the surface free energy tends to distribute when a user prints tables such as quotations and project protocols having definite forms in a large number. The distribution tends to occur not in the circumference direction but in the longitudinal direction. The distribution in the longitudinal direction is not preferred because the quality of images easily deteriorates due to the deterioration of the cleaning performance.

JOP H11-311875 also describes an image forming apparatus using an inexpensive organic image bearing member. However, in an image forming apparatus using such an organic image bearing member, the organic image bearing member is easily abraded by the friction between the organic image bearing member and a cleaning blade. Therefore, to obtain an organic image bearing member having a long life, it is desired to thicken the layer thickness of the organic image bearing member to allow for the decrease of the layer thickness due to the abrasion thereof. Naturally, the layer thickness significantly decreases as image formation is repetitively performed. Therefore, the electric capacitance of the image bearing member significantly changes after repetitive use thereof. It is thus difficult to make the image density constant. JOP H11-311875 further describes an organic image bearing member having a surface layer containing a fluorine compound. However, since the abrasion rate of the surface layer containing a fluorine compound is not significantly slow in comparison with the case in which a typical organic image bearing member is used, the surface layer still has a considerable thickness. But since too thick a layer hinders the transfer of positive holes, the voltage after irradiation and the remaining voltage tend to rise. Consequently, it is not suitable to use the organic image bearing member in an image forming apparatus for producing quality images.

To improve the anti-abrasion property of an inexpensive organic image bearing member, JOP H01-170951 describes an organic image bearing member containing a filler such as a metal oxide in the surface layer thereof. This image bearing member is preferred since the image bearing member has an extremely excellent anti-abrasion property. However, the surface free energy of this organic image bearing member rises during image formation, resulting in deterioration of transfer efficiency, which may lead to production of abnormal images having, for example, hollow defects. Further, there is another drawback that the cleaning blade is abraded over time so that the cleaning performance tends to deteriorate.

Japanese patent No. 2859646 and JOP 2002-229241 describe a technology in which lubricant materials externally added to toner particles are transferred (attached) to an image bearing member when an image is developed on the image bearing member with the toner during image formation. Thereby, the surface free energy of the image bearing member is reduced. This technology is extremely preferred because the friction between the image bearing member and a cleaning blade can be reduced and the cleaning performance for removing the remaining toner is secured. However, since the lubricant materials are supplied only to the developed portions on the image bearing member, the surface free energy of the non-developed portions is kept high. Therefore, when a user prints tables such as quotations and project protocols having definite forms in a large amount, the surface free energy of the image bearing member tends to significantly vary. The cleaning blade tends to vibrate at the border of an area having a high surface free energy and an area having a low surface free energy, which may lead to poor cleaning performance and squawky friction noise.

SUMMARY OF THE INVENTION

Because of these reasons, the present inventors recognize that a need exists for a highly durable image forming apparatus and a process cartridge which can produce quality images.

Accordingly, an object of the present invention is to provide a highly durable image forming apparatus and a process cartridge which can produce quality images.

Briefly this object and other objects of the present invention as hereinafter described will become more readily apparent and can be attained, either individually or in combination thereof, by an image forming apparatus which includes an image bearing member having a surface free energy of not less than 45 mN/m, a charging device for charging the image bearing member, an irradiating device for irradiating the image bearing member with light to form a latent electrostatic image thereon, a developing device for developing the latent electrostatic image with a toner optionally containing a lubricant material, a transfer device for transferring the developed image to a transfer medium, a cleaning device for cleaning the surface of the image bearing member, and optionally a lubricant material supplying device for supplying a lubricant material to the surface of the image bearing member. A lubricant material is supplied to the surface of the image bearing member by at least one of the toner and the lubricant supplying device so that the surface free energy on average in an image formation area on the image bearing member is not greater than 32 mN/m while the maximum difference of the surface free energy is not greater than 5 mN/m.

In cases where both the toner and the lubricant material supplying device supply lubricant material as aforesaid, the lubricant materials they respectively supply may be the same or different.

It is preferred that, in the image bearing member mentioned above, the surface free energy of the image bearing member is measured during image formation area by area, each of which has a width of not greater than 50 mm in an orthogonal direction to a rotation direction of the image bearing member.

It is still further preferred that, in the image bearing member mentioned above, the lubricant material is supplied after the surface of the image bearing member is cleaned.

It is still further preferred that, in the image bearing member mentioned above, the image bearing member has a diameter of from 35 to 100 mm.

It is still further preferred that, in the image bearing member mentioned above, the lubricant material is a metal soap.

It is still further preferred that, in the image bearing member mentioned above, the surface free energy of the image bearing member is obtained from linear recurrence of contact angle data of the image bearing member and at least 4 kinds of liquids by a method of measuring the surface free energy of a solid in which a contact angle formed between the surface of the solid and a liquid whose surface free energy components are known is measured and the following relationship based on the Extended Fowkes Theory is used:

$$\gamma_L(1+\cos\theta)=2\sqrt{\gamma_S^a\gamma_L^a}+2\sqrt{\gamma_S^b\gamma_L^b}+2\sqrt{\gamma_S^c\gamma_L^c}$$

In the relationship, $\gamma_L$ represents the surface free energy of the liquid represented by $\gamma^a_L+\gamma^b_L+\gamma^c_L$, $\gamma^a_L$ represents the dispersion component of the surface free energy of the liquid, $\gamma^b_L$ represents the dipole component thereof, $\gamma^c_L$ represents the hydrogen linking component thereof, $\gamma^a_S$ represents the dispersion component thereof the surface free energy of the solid, $\gamma^b_S$ represents the dipole component thereof, $\gamma^c_S$ represents the hydrogen linking component thereof, and $\theta$ represents the contact angle.

It is still further preferred that, in the image bearing member mentioned above, the liquids for use in measuring the contact angle to obtain the surface free energy of the image bearing member are selected from the group consisting of methylene iodide, α-bromonaphthalene, diethylene glycol, glycerine, and formamides.

It is still further preferred that, in the image bearing member mentioned above, an image information calculation device for calculating image information area by area is provided, each of which is formed by dividing the surface of an image bearing member in the direction perpendicular to the rotation direction of the image bearing member and charging/irradiation/development having a purpose other than image formation is performed based on the image information.

It is still further preferred that, in the image bearing member mentioned above, each area has a width of not greater than 30 mm.

It is still further preferred that, in the image bearing member mentioned above, the image information calculation device calculates information on image area for a driving area of the surface of the image bearing member.

It is still further preferred that, in the image bearing member mentioned above, irradiation patterns are determined based on the image information for each area and irradiation and development are performed for a purpose other than image formation.

It is still further preferred that, in the image bearing member mentioned above, the average particle diameter of the toner is not greater than 7 μm.

It is still further preferred that the image bearing member mentioned above has the highest image definition of not less than 1,000 dpi.

As another aspect of the present invention, a process cartridge is provided which includes an image bearing member having a surface free energy of not less than 45 mN/m, at least one of a charging device for charging the image bearing member, a developing device for developing the latent electrostatic image with a toner optionally containing a lubricant material and a cleaning device for cleaning the surface of the image bearing member, and optionally a lubricant material supplying device for supplying a lubricant material to the surface of the image bearing member. A lubricant material is supplied to the surface of the image bearing member by at least one of the toner and the lubricant material supplying device so that the surface free energy on average in an image formation area on the image bearing member is not greater than 32 mN/m while the maximum difference of the surface free energy is not greater than 5 mN/m.

As another aspect of the present invention, an image forming method is provided which includes charging an image bearing member having a surface free energy of not less than 45 mN/m by a charging device, irradiating the image bearing member with light to form a latent electrostatic image on the image bearing member by an irradiating device, developing the latent electrostatic image with a toner optionally comprising a lubricant material by a developing device, transferring the developed image to a transfer medium by a transfer device, cleaning the surface of the image bearing member and optionally supplying a lubricant material to the surface of the image bearing member by a lubricant material supplying device. A lubricant material is supplied to the surface of the image bearing member by at least one of the toner and the lubricant material supplying device so that the surface free energy on average in an image formation area on the image bearing member is not greater than 32 mN/m while a difference between the maximum and the minimum of the surface free energy is not greater than 5 mN/m.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
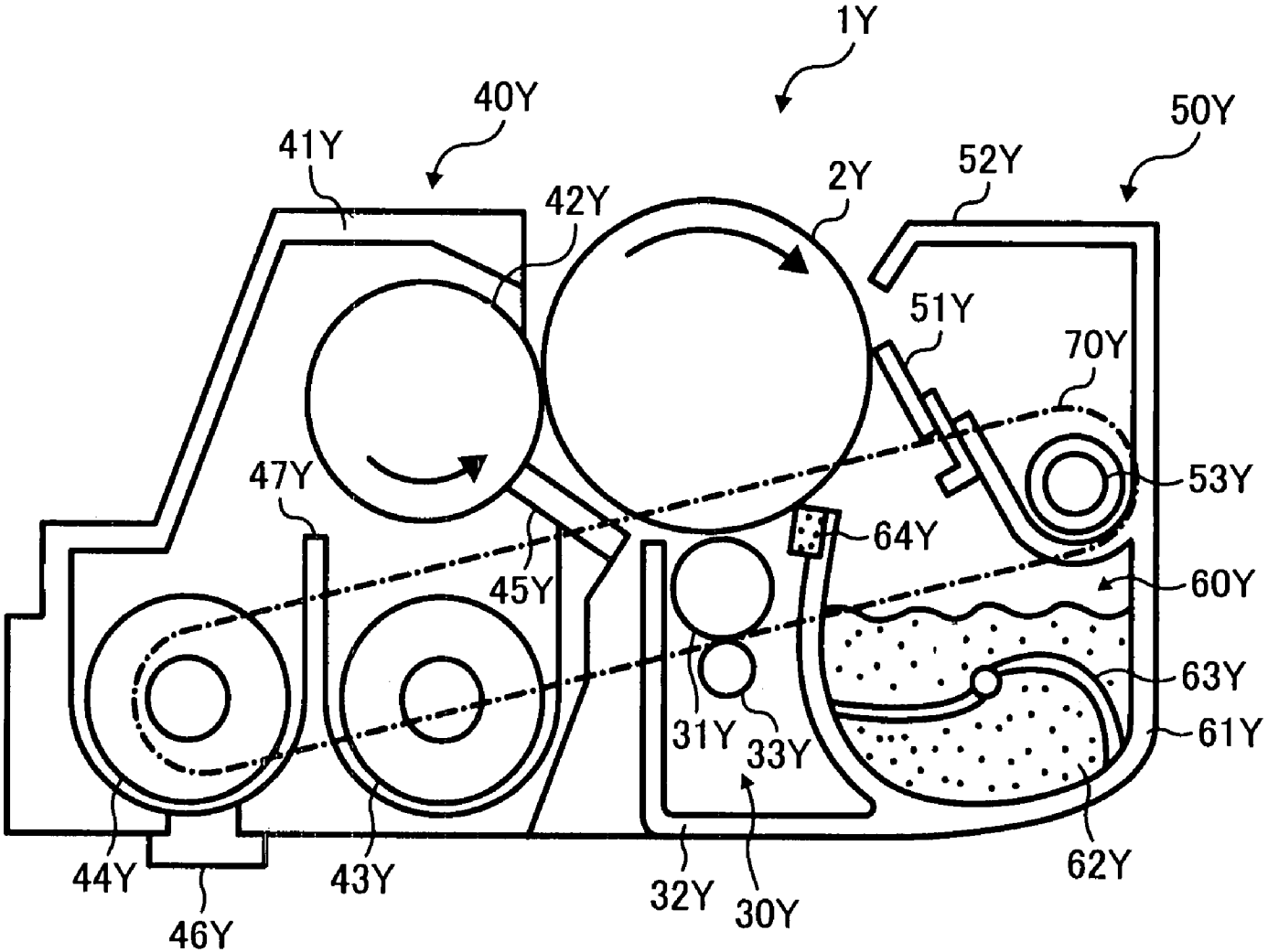
FIG. 1 is a schematic diagram illustrating an example of the image forming unit provided to the image forming apparatus (printer) of the present invention.

The present invention will be described below in detail with reference to several embodiments and accompanying drawings.

First, the method of measuring the surface free energy in the present invention is described.

With regard to the surface free energy (synonymous with surface tension), Yasuaki Kitazaki, Toshio Hata, et al., said in 8(3), 131-141 (1972) of Journal of Japan Adhesion Society that it is possible to extend Fowkes Theory about non-polar intermolecular force to the component of polar intermolecular force or hydrogen linking intermolecular force. According to this Extended Fowkes Theory, the surface free energy of a material can be obtained by the three components.

This theory works out on the following three assumptions.

Assumption 1

The surface free energy of an organic material can be represented by the sum of the following three different components.

[Relationship 1]

$$\gamma^a = \gamma^b + \gamma^b + \gamma^c \quad (1)$$

In the relationship (1), $\gamma^a$ represents the dispersion component (wettability ascribable to non-polarity), $\gamma^b$ represents the dipolar component (wettability ascribable to polarity) and $\gamma^c$ represents the hydrogen linking component (wettability ascribable to hydrogen linking).

Assumption 2

Each of the surface free energies diminished as a result of the contact between two materials can be represented by the sum of geometrical means of the corresponding surface free energy. When one of the two materials does not have a component corresponding thereto, it is considered that there is no interaction of the component.

[Relationship 2]

$$\gamma_{12}=\gamma_1+\gamma_2-2\sqrt{\gamma_1^a\gamma_2^a}-2\sqrt{\gamma_1^b\gamma_2^b}-2\sqrt{\gamma_1^c\gamma_2^c} \quad (2)$$

Assumption 3

Standard materials are classified into the following three types:

TYPE (A) $\gamma=\gamma^a$ type: liquid and solid of saturated hydrocarbons.

TYPE (B) $\gamma=\gamma^a+\gamma^b$ type: liquid and solid other than TYPE (A) and TYPE (C).

TYPE (C) $\gamma=\gamma^a+\gamma^b+\gamma^c$ type: liquid and solid having a hydrogen linking and soluble in water or having a small boundary tension with water.

Based on these assumptions, the surface free energy can be obtained as follows:

When $W_{12}$ represents the attachment energy of materials 1 and 2, the relationship is as follows:

[Relationship 3]

$$W_{12}=\gamma_1+\gamma_2-\gamma_{12} \quad (3)$$

According to relationship (2), $W_{12}$ satisfies the following relationship (4):

$$W_{12}=2\sqrt{\gamma_1^a\gamma_2^a}+2\sqrt{\gamma_1^b\gamma_2^b}+2\sqrt{\gamma_1^c\gamma_2^c} \quad (4)$$

Figure 8:
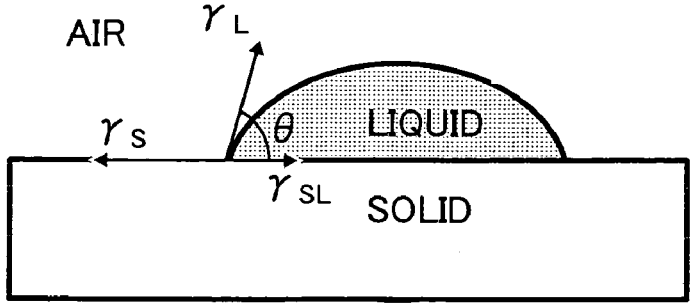
FIG. 8 is a diagram illustrating the state in which a liquid achieves equilibrium on a solid with a contact angle of θ.

When the materials 1 and 2 are a liquid and a solid and a droplet of the liquid achieves equilibrium on the solid with the contact angle θ as illustrated in FIG. 8, the following Young's equation (relationship (5)) is satisfied:

$$\gamma_S=\gamma_{SL}+\gamma_L\cos\theta \quad (5)$$

Therefore, according to the relationships (3) and (5), the contact angle and the attachment energy satisfy the following relationship (6).

$$W_{SL}=\gamma_L(1+\cos\theta) \quad (6)$$

According to the relationships (4) and (6), the following relationship (7) is satisfied.

$$\gamma_L(1+\cos\theta)=2\sqrt{\gamma_S^a\gamma_L^a}+2\sqrt{\gamma_S^b\gamma_L^b}+2\sqrt{\gamma_S^c\gamma_L^c} \quad (7)$$

The contact angle of a liquid of Type A is measured to obtain $\gamma_s^a$ based on the relationship (7). Then, the contact angle of a liquid of Type B is measured to obtain $\gamma_s^b$. $\gamma_s^a$ and $\gamma_s^b$ can be obtained from simultaneous equations formed based on the data of two kinds of liquids of Type B. Next, the contact angle of a liquid of Type C is measured to obtain $\gamma_s^c$ so that each component of the surface free energy of a solid can be obtained. It is also possible to obtain each component of the surface free energy of a solid using a three-dimensional equation formed based on the data of three kinds of liquids in which $\gamma_L^b$ or $\gamma_L^c$ are not zero.

However, when each component of the surface free energy of a solid is obtained based on the method mentioned above, the square root (for example, √γsb) of each component of the surface free energy can be negative depending on cases. For example, when $\sqrt{\gamma_s^b}$ is negative, $\gamma_s^b$ is not obtained by forcibly multiplying √γsb with √γsb but is calculated as 0. In the method of using the contact data of three kinds of liquids, the surface free energy of a solid varies depending on the combinations of the liquids, which leads to a problem of selection of the combination thereof. In addition, the contact angle varies depending on the surface form of a sample so that the measured surface free energy is not reliable. However, it is difficult by a typical method to know whether or not the measured surface free energy is correct. Such a drawback tends to occur especially when water is selected as one of the three kinds of liquids. The surface free energy can be calculated but it is difficult to determine whether the calculated value is true.

When the following replacement is made in Extended Fowkes Theory, $$y \equiv 1+\cos\theta,$$

$$a \equiv \sqrt{\gamma_S^a},$$

$$b \equiv \sqrt{\gamma_S^b},$$

$$c \equiv \sqrt{\gamma_S^c},$$

$$x_1 \equiv 2\frac{\sqrt{\gamma_L^a}}{\gamma_L},$$

$$x_2 \equiv 2\frac{\sqrt{\gamma_L^b}}{\gamma_L},$$

$$x_3 \equiv 2\frac{\sqrt{\gamma_L^c}}{\gamma_L}$$

What is obtained is as follows (relationship (8)):

$$y=ax_1+bx_2+cx_3 \quad (8)$$

Therefore, each component (a,b,c) of the surface free energy of a solid can be obtained by the linear recurrence using the contact angle data (y; x1, x2, x3) of the standard materials. In the typical method in which the surface free energy is obtained from the contact angle data of three kinds of liquids, three unknowns are solved from three equations. Therefore, the surface free energy of a solid is greatly affected when the contact angle of a liquid is somehow away from the true value. In the method for use in the present invention which uses at least 4 kinds of contact angle data, the deviation from the true contact angle value can be evened out so that the effect of the measuring error of the contact angle is reduced.

When the surface free energy is obtained using linear recurrence, multiple correlation coefficient (R−2) can be calculated. When R−2 is close to 1, the contact angle data are true to the Extended Fowkes Theory. Therefore, the obtained surface free energy can be determined to be reliable. That is, it is possible to easily determine the reliability of the measurement according to the value of R−2. As judgment criteria, when R−2 is not less than 0.8, the measurement result can be reliable. When R−2 is small and the measurement result is determined to be not reliable, the contact angle is thought to be not correctly measured. In most cases, this is ascribable to the surface form of a sample. It is desired to devise the form of such a sample to reduce gap and roughness. As a method of preparing a sample having a form with relatively small gap and roughness, there are compacting methods and thermofusion methods.

The calculation method according to linear recurrence is as follows.

When there are contact angle data for n (n is an integer not less than 3) kinds of liquids, that is represented by the following relationship (9).

$$y_i=ax_{i1}+bx_{i2}+cx_{i3} \quad i=1\sim n \quad (9)$$

When the error is represented by $\epsilon$, the error $\epsilon$ can be represented by the following relationship (10):

$$\epsilon_i = y_i - (ax_{i1} + bx_{i2} + cx_{i3}) \quad i=1\sim n \tag{10}$$

The sum of the square error is represented by the following relationship (11).

$$S(a, b, c) = \sum_i \varepsilon_i^2 = \sum_i [y_i - (ax_{i1} + bx_{i2} + cx_{i3})]^2 \tag{11}$$

(a,b,c) is determined in such a manner that the sum of the square error is minimum.

The conditions for (a,b,c) to be minimum are as follows (relationships 12, 13 and 14):

$$\frac{\partial S}{\partial a} = 0 \tag{12}$$

$$\frac{\partial S}{\partial b} = 0 \tag{13}$$

$$\frac{\partial S}{\partial c} = 0 \tag{14}$$

When these are calculated, according to the relationships (12), (13) and (14), the following relationships (15), (16) and (17) are obtained, respectively.

$$\Sigma x_{i1}^2 a + \Sigma x_{i1} x_{i2} b + \Sigma x_{i1} x_{i3} c = \Sigma x_{i1} y_i \tag{15}$$

$$\Sigma x_{i2} x_{i1} a + \Sigma x_{i2}^2 b + \Sigma x_{i2} x_{i3} c = \Sigma x_{i2} y_i \tag{16}$$

$$\Sigma x_{i3} x_{i1} a + \Sigma x_{i3} x_{i2} b + \Sigma x_{i3}^2 c = \Sigma x_{i3} y_i \tag{17}$$

(a,b,c) can be obtained by solving the three-dimensional simultaneous equations (15) to (17). The surface free energy is thus obtained by squaring each of the obtained (a,b,c).

However, there may be a case in which either of (a,b,c) is negative. (a,b,c) are the square root. Therefore, (a,b,c) should not be negative and the calculation should be made under the condition of $a \geqq 0$, $b \geqq 0$ and $c \geqq 0$.

Since S(a,b,c) is two-dimension for (a,b,c), when any one of (a,b,c) is a negative value, for example, c is a negative value, C is treated as 0. In this case, (a,b) is calculated to minimize S(a,b,0). Further, when b is a negative value as well, b is treated as 0, a is obtained to minimize (a,0,0). However, even when c is a negative value, S can be small by calculating (a,c) to minimize S(a,0,c) (i.e., b=0). Therefore, when any one of (a,b,c) is a negative number, calculations should be made for each case of a=0, b=0, a=b=0, a=c=0, and b=c=0. The solution is that S is minimum under the condition of $a \geqq 0$, $b \geqq 0$ and $c \geqq 0$.

R−2 can be calculated by the following relationship (18).

$$R^2 = 1 - \frac{\sum \varepsilon_i^2}{\sum y_i^2 - (\sum y_i)^2 / n} \tag{18}$$

According to (11) and (18), when S is the minimum, $R^2$ is the maximum.

The standard materials are allowed to take any combination of at least 4 kinds of liquids in which each component is already known and $\gamma_L^b$ or $\gamma_L^c$ is not 0 in all the liquids. Liquids in which each component of the surface free energy is already known are desired to not have extensive wettability. The extensive wettability is a phenomenon in which, when a droplet is placed on a solid, wetness voluntarily expands. It is impossible to measure the contact angle of a material having such extensive wettability. The liquids of Type A have extensive wettability for most organic compounds.

TABLE 1

Surface free energy of Type A compounds

| Alkanes | Y liquid mN/m | $Y^a$ mN/m | $Y^b$ mN/m | $Y^c$ mN/m |
|---|---|---|---|---|
| n-Hexadecane | 27.6 | 27.6 | 0 | 0 |
| n-Tetradecane | 26.7 | 26.7 | 0 | 0 |
| n-Dodecane | 25.4 | 25.4 | 0 | 0 |
| n-Undecane | 24.7 | 24.7 | 0 | 0 |
| n-Decane | 23.9 | 23.9 | 0 | 0 |
| n-Nonane | 22.9 | 22.9 | 0 | 0 |
| n-Octane | 21.8 | 21.8 | 0 | 0 |
| n-Heptane | 20.3 | 20.3 | 0 | 0 |
| n-Hexane | 18.4 | 18.4 | 0 | 0 |
| Transdecalin | 29.9 | 29.9 | 0 | 0 |

TABLE 2

Surface free energy of Type B compounds

| Liquid | Y liquid mN/m | $Y^a$ mN/m | $Y^b$ mN/m | $Y^c$ mN/m |
|---|---|---|---|---|
| Methylneniodide | 50.8 | 46.8 (0.6) | 4 | 0 |
| Tetrabromoethane | 47.5 | 44.3 (1.0) | 3.2 | 0 |
| α-Bromonaphthalene | 44.6 | 44.4 | 0.2 | 0 |
| Arochlor 1242 | 45.3 | 41.5 | 3.8 | 0 |
| Tricesylphosphate | 40.9 | 37.4 (1.5) | 3.5 | 0 |
| Tetrachloroethane | 36.3 | 33.2 (2.9) | 3.1 | 0 |
| Hexachlorobutadiene | 36 | 35.8 | 0.2 | 0 |
| Polydimethylsiloxane | 19.9 | 18.1 | 1.8 | 0 |

Standard deviation in parenthesis

TABLE 3

Surface free energy of Type C compounds

| Liquid | Y liquid mN/m | $Y^a$ mN/m | $Y^b$ mN/m | $Y^c$ mN/m |
|---|---|---|---|---|
| Water | 72.8 | 29.1 (3.1) | 1.3 (1.1) | 42.4 |
| Glycerol | 63.4 | 37.4 (2.5) | 0.2 (0.2) | 25.8 |
| Formaide | 58.2 | 35.1 (2.6) | 1.6 (0.3) | 21.5 |
| Thiodiglycol | 54 | 39.2 (0.4) | 1.4 (1.1) | 13.4 |
| Ethylene Glycol | 47.7 | 30.1 (1.6) | 0 | 17.6 |
| Diethylene Glycol | 44.4 | 31.7 (1.2) | 0 | 12.7 |
| Polyethylene Glycol 200 | 43.5 | 29.9 (1.5) | 0.1 | 13.5 |
| Dipropylene glygol | 33.9 | 29.4 (0.7) | 0 | 4.5 |

Standard deviation in parenthesis

As a combination of the standard materials for use in measuring the surface free energy of an organic compound, it is preferred not to use a liquid of Type A but a combination of at least two kinds of liquids of Type B and at least two kinds of liquids of Type C. The values obtained in the surface free energy measurement vary depending on the combination of the liquids for use in measurement. But in the combination of at least two kinds of liquids of Type B and at least two kinds of liquids of Type C, almost the same values are obtained and stable.

As a solvent for use in measuring the surface free energy of the surface of an image bearing member in an image forming apparatus of the present invention, for example, solvents described in 8(3), 131-141 of Journal of Japan Adhesion Society published in 1972 can be used. It is especially preferred to select such a solvent among methylene iodide, α-bromonaphthalene, diethylene glycol, glycerine, and formamides to obtain a reliable surface free energy of the surface of an image bearing member.

For the image forming apparatus of the present invention, it is good to use an inexpensive organic image bearing member having a surface free energy of not less than 45 mN/m. As described above, in the case of an image bearing member having a surface free energy of not less than 45 mN/m, since the friction between the image bearing member and a cleaning blade is strong, the image bearing member and the cleaning blade are easily abraded. The surface free energy of the surface of an image bearing member can be decreased by applying a lubricant material to the image bearing member while in image formation, which leads to decrease of the friction between the image bearing member and the cleaning blade. However, the surface free energy of an image bearing member for use in the present invention is not less than 45 mN/m, preferably not less than 47 mN/m and more preferably from 48 to 55 mN/m. Therefore, when a lubricant material is not uniformly applied or there is a portion in which a lubricant material is decomposed or deleted, cleaning performance tends to deteriorate and abnormal noise is easily emitted. It is thus desired to control the surface free energy distribution of an image bearing member. The surface free energy of the image bearing member of the present invention is 32 mN/m on average and preferably not greater than 30 mN/m and further from 10 to 28 mN/m during image formation. When the surface free energy of the image bearing member is too great on average during image formation, the friction between the image bearing member and the cleaning blade tends to be strong, which leads to the abrasion of the image bearing member and the cleaning blade. This is not preferred because the cleaning performance deteriorates and abnormal noise is emitted so that the image bearing member and the cleaning blade are frequently exchanged. When the surface free energy is too small on average but has a distribution, the cleaning performance tends to deteriorate and abnormal noise is easily emitted. As the surface free energy decreases, the fluctuation thereof causes a problem. The difference between the maximum and the minimum of the surface free energy of the surface of an image bearing member for use in the image forming apparatus of the present invention during image formation is not greater than 5 mN/m, preferably not greater than 4 mN/m and more preferably not greater than 3 mN/m.

The surface free energy of an image bearing member for use in the image forming apparatus of the present invention does not basically fluctuate greatly with regard to the rotation direction of the image bearing member. Therefore, it is preferred that when the surface free energy is measured using at least 4 kinds of liquids, the contact angle is measured for the at least 4 kinds of liquids along the circumference direction of the image bearing member.

The distribution of the surface free energy of the surface of an image bearing member for use in the present invention is measured for each of the surface areas on the image bearing member divided in the cross direction to the rotation direction thereof. The width of the divided area is not greater than 50 mm, preferably not greater than 30 mm and more preferably from 5 to 25 mm. Too great a width of the divided area is not preferred because it is highly likely that there are portions in which the surface free energy fluctuates more than 5 mN/m in the divided area.

The image forming apparatus of the present invention performs image formation while applying a lubricant material to an image bearing member to reduce the surface free energy of the surface of the image bearing member. In the present invention, it is possible to supply a lubricant material to the surface of the image bearing member by using a toner to which the lubricant material is externally added and/or by using a device to supply a lubricant material. The lubricant material supplied through the toner is not necessarily the same as that supplied by the device. In this case, in the electrophotographic processes of charging, irradiating, developing, transferring and cleaning, the lubricant material is supplied (applied) to the image bearing member between the transfer process and the charging process so as not to affect image formation. When a lubricant material is applied between the transfer process and the cleaning process, the lubricant material can be pressed and stretched by the function of a cleaning blade. However, since the toner remaining after transfer accumulates in the vicinity of the cleaning blade, the applied lubricant material tends to attach to the remaining toner. Therefore, it is highly likely that the amount of applied lubricant increases to control the surface free energy of the image bearing member. Thus, as described in JOP 2005-18047, it is greatly preferred to apply a lubricant material after cleaning in light of controlling the surface free energy with a small amount thereof.

It is preferred to remove the remaining toner in the cleaning process as much as possible. Any combinational use of a cleaning blade, a fur brush, a magnetic brush and an aspiration removal device is preferred to completely remove the remaining toner and suitably control the surface free energy of an image bearing member.

Specific examples of the lubricant materials for use in the image forming apparatus of the present invention include fluorine resins such as polytetra fluoroethyhlene and polyvinylidene fluoride, and metal soaps of zinc stearate, aluminum stearate, lead stearate, magnesium stearate, and lead oleate. It is preferred to use metal soaps which can reduce unevenness of application and decrease the surface free energy of an image bearing member. Considering economy, hazard of the compounds produced by charging, etc., and the influence on an image bearing member, zinc stearate is most preferred.

When a lubricant material is contained in (externally added to) a toner, the addition amount thereof is from 0.01 to 0.5% by weight, and preferably from 0.02 to 0.3% by weight based on the weight of the toner. When the addition amount of a lubricant material is too small, the amount of the lubricant material which can be transferred to the image bearing member is small. Since the surface free energy of an image bearing member for use in the image forming apparatus of the present invention is basically high, when the addition amount of a lubricant material is too small, the surface free energy of the image bearing member tends to vary to a significant extent. This is not preferred because the quality of images can be degraded and abnormal noises may occur. To the contrary, an excessive addition amount of a lubricant material tends to cause a problem in chargeability of the toner, which is not preferred.

When a device to supply a lubricant material is used and simply applies a lubricant material to an image bearing member, the lubricant material effectively reduces the surface free energy of the image bearing member. But, it is greatly preferred to press the lubricant material to the surface of the image bearing member and form a thin film to further reduce the surface free energy of the image bearing member and the variance thereof.

The toner for use in the image forming apparatus of the present invention can secure quality images regardless of the average particle diameter. Especially, a toner having an average particle diameter of not greater than 7 μm and preferably not greater than 6 μm can restrain the occurrence of abnormal images ascribable to poor cleaning performance so that quality images can be produced.

When a lubricant material is contained in a toner for use in the image formation apparatus of the present invention and the toner is not attached to the surface of the image bearing member therein, the lubricant material does not attach thereto, either. If this is the case, the surface free energy of the surface of the image bearing member does not decrease. Therefore, it is desired to provide some contrivances to uniformly attach the toner to the surface of the image bearing member. Without such contrivances, the surface free energy of an image bearing member may exceed the average surface free energy of 32 mN/m for the image bearing member depending on images formed by a user. Also, it may be difficult to make the difference between the maximum and the minimum of the surface free energy of the surface of the image bearing member during image formation operation within 5 mN/m. This is not preferred because poor cleaning performance ascribable to this tends to cause abnormal images and noise.

Therefore, as described in JOP 2000-221769, the image area ratio is calculated and quantity accumulated area by area formed by dividing the surface of an image bearing member in the direction perpendicular to the transfer direction of a developer from the image bearing member. Thereafter, by outputting a solid image to the surface of the image bearing member based on the compared results and cleaning the surface without transfer, the surface free energy of the image bearing member can be maintained constant. This is preferred but it is desired to avoid consuming toners for performance other than image formation because the toner belongs to users. Therefore, it is preferred to clean the surface of the image bearing member without transfer by varying the image area for each divided area according to the accumulated quantity calculation of the image area for each divided area. Thereby, the amount of toner consumed for controlling the surface free energy of the image bearing member can be reduced while the surface free energy of the surface of the image bearing member is limited to a value of not greater than 32 mN/m and the difference between the maximum and the minimum thereof is limited to a value of not greater than 5 mN/m. The size of the divided areas is preferably small but considering the burden of quantity accumulation of the image area, the width of each area is not greater than 50 mm, preferably not greater than 30 mm and more preferably from 1 to 25 mm. When the width is too great, the surface free energy of the surface of an image bearing member tends to vary and the amount of consumed toner tends to rise, which is not preferred.

For the image forming apparatus of the present invention, the timing of cleaning the surface of an image bearing member without transfer can be set at when the difference among the quantity accumulation calculations for the divided area reaches a threshold. But it is preferred to perform the cleaning on a regular interval, for example, per 2,000 image formations, preferably 1,500 image formations and more preferably from 100 to 1,000 image formations in terms of securely controlling the surface free energy of the surface of an image bearing member.

The image forming apparatus of the present invention can produce quality images regardless of the definition. To produce quality images, it is especially effective when the definition is not less than 1,000 dpi and preferably not less than 1,200 dpi.

To remove the toner on an image bearing member, a cleaning blade can be used. A cleaning blade can be set for (leading direction) and against (counter direction) the rotation direction of the image bearing member. A cleaning brush made of polyester textile, nylon textile, etc., can be used in combination, if desired.

The cleaning blade system has an advantage for size reduction of an image forming apparatus. Therefore, most image forming apparatuses adopt the cleaning blade system.

The cleaning blade set in the counter direction can improve cleaning performance because the cleaning blade can bite more into an image bearing member in comparison with a cleaning blade set to the leading direction.

The cleaning blade includes an aluminum or iron board substrate and an elastic board having a hardness of from about 70 to about 80 on JIS-A hardness scale and an impact resilience of from about 30 to 60%. The elastic board is attached to the substrate and cut into rectangles having a width of from 1.5 to 3 mm.

Currently, commonly-used polyurethane rubber suitable for use in such a cleaning blade is easy to be tightly attached to an image bearing member made of a polycarbonate resin so that the friction resistance between the image bearing member and the blade is extremely large.

Polyurethane rubber, silicone rubber, fluorine containing rubber, chloroprene rubber, neoprene rubber and the like are suitably used as resilient bodies for use in such a cleaning blade. Among these, polyurethane rubber is suitably used in terms of durability and impact resilience for cleaning property and mainly made of a polyol, an isocyanate and a curing agent.

Polyurethane rubber is manufactured as follows: mix a dehydrated polyol and isocyanate at 70 to 140° C. for about 100 minutes to obtain a prepolymer; add a curing agent to the prepolymer; place and cure the resultant in a die preliminarily heated to 140 to 160° C. for 50 to 60 minutes; and remove the cured resultant from the die and cut it to a suitable size with a cutting machine.

Below is a description about an embodiment (hereinafter referred to as Embodiment No. 1) in which the present invention is applied to a color laser printer (hereinafter referred to as printer) taking a tandem system including multiple image bearing drums arranged side by side. Embodiment No. 1 is an example in which a lubricant material supplying device is used to supply a lubricant material to the surface of the image bearing member.

Figure 2:
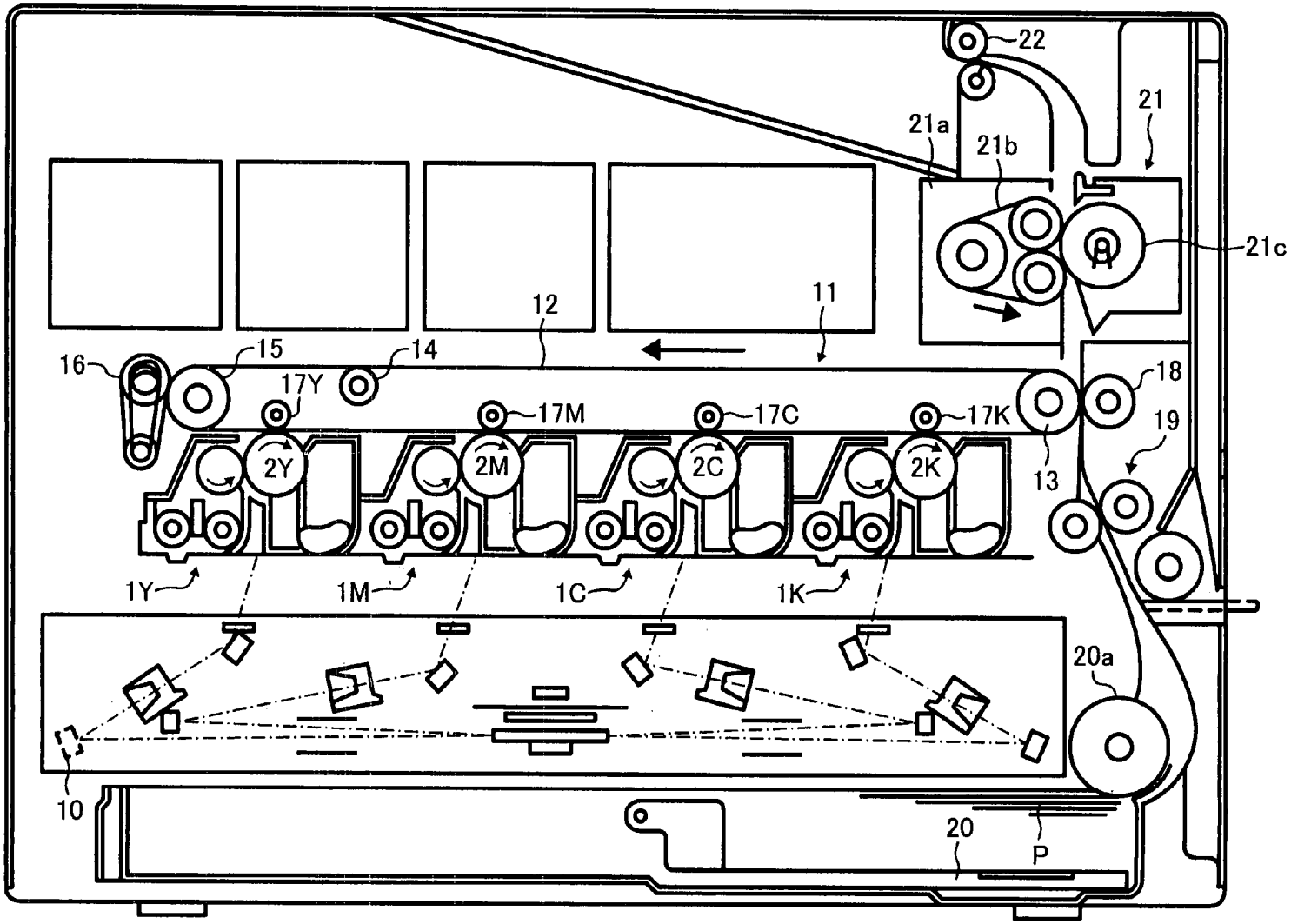
FIG. 2 is a schematic diagram illustrating an example of the image forming apparatus of the present invention.

FIG. 2 is a schematic diagram illustrating a printer related to Embodiment No. 1.

This printer has four image formation units 1Y, 1M, 1C and 1K to form each color image of yellow (Y), magenta (M), cyan (C) and black (K). The characters placed after the number represent members for yellow, magenta, cyan and black. Other than the image formation units 1Y, 1M, 1C and 1K, an optical writing system unit 10, an intermediate transfer unit 11, a secondary transfer bias roller 18, a pair of registration rollers 19, a paper feeding cassette 20, and a fixing unit 21 having a belt form are provided to the printer. The optical writing unit 10 has a light source, a polygon mirror, an f-θ lens, a reflection mirror, etc. and irradiates the surface of the imagebearing drum with a laser beam.

FIG. 1 is an enlarged diagram illustrating a schematic structure of the image formation unit 1Y for yellow among the image formation units 1Y, 1M, 1C and 1K.

This image formation unit 1Y includes an image bearing drum 2Y functioning as a latent image bearing member and a surface moving member, a charging device 30Y functioning as a uniform charging device, a developing device 40Y, a drum cleaning device 50Y, a lubricant material supplying device 60Y, a recycled toner conveying device 70Y, etc. Other image formation units 1M, 1C and 1K have the same structure as that of the image formation unit 1Y.

The charging device 30Y has a charging roller 31Y which is disposed in contact with or in the vicinity of the image bearing drum 2Y to uniformly charge the surface of the image bearing drum 2Y. In Embodiment No. 1, a DC power source (not shown) applies DC voltage to the charging roller 31Y. It is also possible to apply a DC voltage overlapped with an AC voltage. However, as in Embodiment No. 1, just applying only a DC voltage to the charging roller 31Y has an advantage over the case of a DC voltage overlapped with an AC voltage in that the stress to the image bearing drum 2Y can be greatly restrained. In addition, in Embodiment No. 1, the charging roller 31 adopts the contact type charging system. It is also possible to adopt the non-contact type charging system using a corona charger, etc. The contact type charging system is advantageous to the non-contact type charging system in terms of uniform charging and production of ozone.

Further, the charging device 30Y has a brush roller 33Y to remove foreign matters attached to the charging roller 31Y. The brush roller 33Y can be replaced with other cleaning members.

Subsequent to the charging treatment, the optical writing unit 10 modulates and deviates a laser beam and irradiates and scans the surface of the image bearing drum 2Y with the laser beam. Thereby, a latent electrostatic image is formed on the surface of the image bearing drum. The formed latent electrostatic image is developed by the developing device 40Y to form a yellow toner image. The developing device 40Y has a developing roller 42Y provided in such a manner that part of the sphere protrudes from the opening of a development case 41Y. The developing device 40Y also includes a first conveying screw 43Y, a second conveying screw 44Y, a doctor blade 45Y and a toner density sensor 46Y.

The development case 41Y accommodates two-component developer (not shown) containing a magnetic carrier and negatively-charged yellow toner. This two-component developer is friction-charged while stirred and conveyed by the first conveying screw 43Y and the second conveying screw 44Y. Thereafter, the two-component developer is borne on the surface of the developing roller 42Y. Then, the layer thickness of the two-component developer on the developing roller 42Y is regulated by the doctor blade 45Y. When the two-component developer is conveyed to the developing area opposing the image bearing drum 2Y, yellow toner is attracted to the latent electrostatic image on the image bearing drum. A yellow toner image is thus formed on the image bearing drum 2Y. The two-component developer which has consumed yellow toner through development is returned to the development case 41Y in accordance with the rotation of the developing roller 42Y.

A partition wall 47Y is provided between the first conveying screw 43Y and the second conveying screw 44Y. This partition wall 47Y separates the development case 41Y into a first supplying unit accommodating the developing roller 42Y, the first conveying screw 43Y, etc. and a second supplying unit accommodating the second conveying screw 44Y. The first conveying screw 43Y is rotationally driven by a driving force (not shown) and conveys and supplies the two-component developer in the first supply unit from the rear side of FIG. 1 to the front side thereof to the developing roller 42Y. The two-component developer conveyed to the vicinity of the end of the first supplying unit by the first conveying screw 43Y advances into the second supplying unit through an opening (not shown) provided to the partition wall 47Y. In the second supplying unit, the second conveying screw 44Y is rotationally driven by a driving force (not shown) and conveys the two-component developer sent from the first supplying unit in the reverse direction to the direction in which the first conveying screw 43 conveys the two-component developer. The two-component developer conveyed to the vicinity of the end of the second supplying unit by the second conveying screw 44Y is returned to the first supplying unit through the other opening (not shown) provided to the partition wall 47Y.

The yellow toner image thus formed on the image bearing drum 2Y is transferred to the intermediate transfer belt, which is described later. After this first transfer, toner which has not been transferred remains on the surface of the image bearing drum 2Y. The remaining toner is removed by the drum cleaning device 50Y. The drum cleaning device 50Y includes a cleaning blade 51Y, which is brought into contact with the surface of the image bearing drum to scrape and collect the remaining toner attached to the surface thereof. In Embodiment No. 1, the cleaning blade system using the cleaning blade 51Y is adopted to scrape the remaining toner. However, this cleaning blade system can be replaced with another cleaning system such as a brush cleaning system using, for example, a fur brush, or the combination thereof. The inside of the drum cleaning device 50Y is sealed up by the casing 52Y and the image bearing drum 2Y so that the collected remaining toner does not scatter in the printer.

In addition, in the inside of the drum cleaning device 50Y, a conveying screw 53Y is provided to convey the remaining toner to the front direction of FIG. 1. The collected remaining toner is sent to the inside of the recycled toner conveying device 70Y. The recycled toner conveying device 70Y conveys the remaining toner to the developing device 40Y. The outlet of the recycled toner conveying device 70Y is open to the front side of FIG. 1 in the second supplying unit of the developing device 40Y. Therefore, the remaining toner retrieved by the drum cleaning device 50Y is returned to the developing device 40Y by the recycled toner conveying device 70Y. The retrieved toner is stirred and conveyed again by the first conveying screw 43Y and the second conveying screw 44Y in the developing device 40Y and is ready for reuse for development.

A lubricant material is supplied by the lubricant material supplying device 60Y to the surface of the image bearing drum 2Y which has been cleaned by the drum cleaning device 50Y. The structure and the operation of this lubricant material supplying device are described later. The surface of the image bearing drum 2Y to which the lubricant material has been supplied is uniformly charged again by the charging device 30Y to repeat the image formation cycle.

Each color toner image formed on the respective image bearing drums 2Y, 2M, 2C and 2K in each image formation unit 1Y, 1M, 1C and 1K is primarily transferred to the intermediate transfer belt 12 functioning as an intermediate body for the intermediate transfer unit 11. The intermediate transfer belt 12 has an endless form. As illustrated in FIG. 2, the intermediate transfer unit 11 includes a driving roller 13, suspension rollers 14 and 15, a belt cleaning device 16 and four primary transfer bias rollers 17Y, 17M, 17C and 17K. While the intermediate transfer belt 12 is suspended over the driving roller 13, and the suspension rollers 14 and 15, the intermediate transfer belt 20 is rotationally driven counterclockwise by the driving roller 13 driven by a driving system (not shown). To the four primary transfer bias rollers 17Y, 17M, 17C and 17K, a primary transfer bias is applied by respective power sources. The four primary transfer bias rollers 17Y, 17M, 17C and 17K press the intermediate transfer belt 12 against the image bearing drums 2Y, 2M, 2C and 2K from the back of the intermediate transfer belt 12 to form primary transfer nips. At each primary transfer nip, a primary transfer electric field is formed between the image bearing drums and the primary transfer bias rollers by the influence of the primary transfer bias. The yellow toner image formed on the image bearing drum 2Y for yellow is primarily transferred to the intermediate transfer belt 12 by this primary transfer electric field and the nip pressure. The magenta toner image, the cyan toner image and the black toner image formed on the image bearing drums 2M, 2C and 2K, respectively, are overlapped on the yellow toner image to complete the primary transfer. The four color overlapped toner image is thus formed on the intermediate transfer belt 12. The four color overlapped toner image is secondarily transferred to a transfer medium P serving as a recording medium by a secondary transfer nip, which is described later. The toner remaining on the surface of the intermediate transfer belt 12 after passing the secondary transfer nip is removed by the belt cleaning device 16 while the belt cleaning device 16 contacts the intermediate transfer belt 12 suspended by the suspension roller 15.

The driving roller 13 of the intermediate transfer unit 11 contacts the secondary transfer bias roller 18 to form the secondary transfer nip with the intermediate transfer belt 12 therebetween. A secondary transfer bias is applied to the secondary transfer bias roller 18 by a power source (not shown). Below the optical writing unit 10, the paper feeding cassette 20 is provided to accommodate a plurality of transfer media P placed on each other. The paper feeding roller 20*a* is pressed on the transfer medium P placed at the top. When the paper feeding roller 20*a* rotates at a determined timing, the transfer medium P placed at the top is fed to the paper path. The transfer medium P fed from the paper feeder cassette 20 to the paper path is nipped between the pair of the registration rollers 19. On the other hand, the four color overlapped toner image advances to the secondary transfer nip by the movement of the belt. The pair of the registration rollers 19 send the transfer medium P nipped between the pair of the registration rollers 19 to the timing at which the four color overlapped toner image can be pressed to the transfer medium P at the secondary transfer nip. Thereby, the four color overlapped toner image is attached and secondarily transferred to the transfer medium P at the secondary transfer nip. The four color toner image forms a full color toner image on white color of the transfer medium P. The transfer medium P on which the full color image is formed is sent to the fixing unit 21.

The fixing unit 21 includes a belt unit 21*a*, a belt unit 21*b* and a heating roller 21*c* having a heat source therein. The belt unit 21*b* endlessly moves the fixing belt 21*a* while suspending the fixing belt 21*a* with three rollers. While the fixing unit 21 nips the transfer medium P between the belt unit 21*b* and the heating roller 21*c*, the full color image is fixed on the transfer medium P. The transfer medium P is discharged from the printer via a pair of discharging rollers 22 after passing through the fixing unit 21.

Next, the structure and the operation of the lubricant material supplying device 60Y are described. The other lubricant material supplying devices 60M, 60C and 60K provided to the image formation units 1M, 1C and 1K, respectively, have the same structure as the lubricant material supplying device 60Y.

As illustrated in FIG. 1, the lubricant material supplying device 60Y accommodates a lubricant material 62Y having a powder form in the inside (closed space) of the casing 61Y. The lubricant material 62Y is provided to reduce the friction coefficient between the surface of the image bearing drum 2Y and the cleaning blade 51Y, or materials such as the yellow toner or a carrier which contacts the surface thereof. In the casing 61Y of the lubricant material supplying device 60Y, an agitator 63Y functioning as a lubricant material supplying member is provided to supply the lubricant material 62Y to the surface of the image bearing drum 2Y. This agitator 63Y has a structure including rotating two wing members attached to the rotation axis extending parallel to the drum axis of the image bearing drum 2Y. When the rotating two wing members rotate, the lubricant material 62Y is forced to fly to the surface of the image bearing drum 2Y and is attached thereto.

The casing 61Y of the lubricant material supplying device 60Y in Embodiment No. 1 is integrally structured with a casing 52Y of the drum cleaning device 50Y and a casing 32Y of the charging device 30Y. The lubricant material supplying device 60Y, the drum cleaning device 50Y and the charging device 30Y are integrally structured with the image bearing drum 2Y and these devices are detachably attached to the main body of a printer as a process cartridge. The inside spaces of each casing 32Y, 52Y and 61Y are separated by its own casing portion and the cleaning blade 51Y. The lubricant material supplying material 60Y is provided outside the drum cleaning device 50Y.

The casing 61Y of the lubricant material supplying device 60Y in Embodiment No. 1 is structured of the portion shared with the other casings, i.e., the casing 32Y and the casing 52Y, and the cleaning blade 51Y. The casing 61Y is open only to the side opposing the surface of the image bearing drum 2Y. The cleaning blade 51Y forms the upstream side of the casing 61Y relative to the rotation direction of the image bearing drum 2Y and is brought into contact with the surface of the image bearing drum 2Y along the axis direction thereof. On the other hand, a sealing member 64Y provided on the peripheral portions of the casing portion on the downstream side of the casing 61Y relative to the rotation direction of the image bearing drum 2Y is brought into contact with the image bearing drum 2Y all over along the axis direction thereof. Further, as to the opening end positioned at the end of the axis of the image bearing drum 2Y, a sealing member (not shown) contacts the surface of the image bearing drum 2Y along the surface moving direction thereof. That is, in Embodiment No. 1, all the peripheral portions of the casing 61Y of the lubricant material supplying device 60Y contacts all over the surface of the image bearing drum 2Y. Therefore, the inner space surrounded by the inside wall of the casing 61Y and the surface portion of the image bearing drum 2Y is a closed and shielded space from outside. In Embodiment No. 1, as described above, when the agitator 63Y rotates, the lubricant material 62Y is supplied and attached to the surface of the image bearing drum 2Y in this closed space. Thereafter, the lubricant material 62Y attached to the surface of the image bearing drum 2Y moves with the surface movement of the image bearing drum 2Y and passes through the contact portion of the sealing member 64Y and the image bearing drum 2Y.

It is possible to greatly reduce the mechanical stress on the image bearing drum 2Y in the image formation process described above by attaching the lubricant material 62Y to the surface of the image bearing drum 2Y. Namely, it is possible to reduce the mechanical stress such as abrasion by a developer in the development area and scraping by the cleaning blade 51Y. This leads to an effect of elongating life of the image bearing drum 2Y. This is especially effective when the image bearing drum 2Y is integrally structured with other devices as a process cartridge. In general, since the life of the image bearing drum is the shortest among the devices included in a process cartridge, the frequency of replacement of the process cartridge depends on the life length of the image bearing drum. Therefore, elongation of the life of the image bearing drum 2Y has an effect that the frequency of replacement of a process cartridge can be reduced. As a result, the other devices replaced together with the image bearing drum 2Y before the lives thereof end can be effectively used and the user convenience is improved.

In addition, the lubricant material 62Y attached to the surface of the image bearing drum 2Y weakens the mechanical adhesion between the surface of the image bearing drum 2Y and the toner, resulting in improvement of the transfer efficiency and image quality and reduction of the amount of the remaining toner.

Further, according to Embodiment No. 1, the lubricant material 62Y is supplied to the surface of the image bearing drum 2Y in the closed and shielded space mentioned above. The lubricant material supplied to the image bearing drum 2Y is prevented from scattering in the printer and the lubricant not supplied to the image bearing drum 2Y stays in the closed and shielded space. In addition, since the lubricant material device 60Y is disposed outside the drum cleaning device 50Y, the lubricant material 62Y to be supplied to the image bearing drum 2Y is not directly collected by the drum cleaning device 50Y without being supplied to the image bearing drum 2Y. In Embodiment No. 1, the lubricant material 62Y which flies to the image bearing drum 2Y by the agitator 63Y but is not supplied to the image bearing drum 2Y drops in the casing 61Y and is supplied to the image bearing drum 2Y again. Therefore, in Embodiment No. 1, all the lubricant material 62Y accommodated in the casing 61Y can be supplied to the image bearing drum 2Y without waste. Further, since the lubricant material supplying device 60Y is disposed on the downstream side of the drum cleaning device 50Y relative to the rotation direction of the image bearing drum 2Y, the lubricant material 62Y can be stably supplied to the image bearing drum 2 irrespective of the amount of the remaining toner on the drum cleaning device 50Y. Further, since the lubricant material supplying device 60Y is disposed on the downstream side of the drum cleaning device 50Y and the upstream side of the charging device 30Y relative to the rotation direction of the image bearing drum 2Y, the lubricant material is stably applied to the surface of the image bearing drum 20Y when the image bearing drum 2Y passes the charging device 30Y. Thereby, the amount of the attachment of the lubricant material 62Y to the charging device 30Y can be reduced.

Further, in Embodiment No. 1, the remaining toner retrieved by the drum cleaning device 50Y can be returned to the developing device 40Y by the recycled toner conveying device 70Y for reuse. In a typical image formation apparatus in which the remaining toner is retrieved in a drum cleaning device by a brush roller while a lubricant material is supplied thereto, a large amount of the lubricant material is mixed in the remaining toner. In general, typical lubricant materials such as zinc stearate are known to have an adverse affect on friction charging of toner. To be specific, when zinc stearate (lubricant material) is mixed with a negatively charged toner as in Embodiment No. 1, the amount of charge of the entire toner is reduced (shifted to the positive side). When the mixture amount of the lubricant material is too large, the amount of charge of the toner is short, resulting in the occurrence of background fouling. Consequently, it is extremely difficult to reuse the remaining toner retrieved by a drum cleaning device while restraining the occurrence of the background fouling. To the contrary, in Embodiment No. 1, since the lubricant material supplying device 60Y is provided outside the drum cleaning device 50Y as described above, the lubricant material 62Y does not directly move in from the lubricant material supplying device 60Y to the drum cleaning device 50Y. In addition, in Embodiment No. 1, the lubricant material supplying device 60Y supplies a lubricant material at a place which is on the downstream side of the cleaning point (the contact point of the cleaning blade 51Y) of the drum cleaning device 50Y relative to the rotation direction of the image bearing drum 2Y. The lubricant material 62Y attached to the surface of the image bearing drum 2Y reaches the cleaning point of the drum cleaning device 50Y via the charging area, the developing area and the primary transfer area while the surface of the image bearing drum 2Y moves. Some of the lubricant material 62Y on the image bearing drum 2Y is retrieved in the developing area by the charging roller 31Y, in the developing area by the developing device 40Y, and in the primary transfer area by the intermediate transfer belt 12. Therefore, the amount of the lubricant material 62Y on the image bearing drum 2Y supplied from the lubricant material supplying device 60Y diminishes before reaching the cleaning point. Therefore, the amount of the lubricant material 62Y mixed with the remaining toner retrieved by the drum cleaning device 50Y is extremely small in comparison with that in a typical image bearing member. As a result, according to Embodiment No. 1, an image forming apparatus can reuse the remaining toner retrieved by the drum cleaning device 50Y and sufficiently restrain the occurrence of the background fouling even when the image forming apparatus has a mechanism to supply to the image bearing drum 2Y the lubricant material 62Y having an adverse impact on friction charging of the toner.

Further, in Embodiment No. 1, the lubricant material is supplied by the lubricant material supplying device 60Y at a place on the downstream side of the cleaning point of the drum cleaning device 50Y and the upstream side of the development area (where toner is attached to the surface of the image bearing drum 2Y) relative to the rotation direction of the image bearing drum 2Y. Therefore, the toner hardly interfuses into the lubricant material supplying device 60Y. When a toner interfuses into the lubricant material supplying device 60Y, the toner is mixed with the lubricant material 62Y and the amount of charge of the toner decrease as described above. When images are formed with such a toner attached to the surface of the image bearing drum 2Y together with the lubricant material 62Y, the background fouling tends to occur. In Embodiment No. 1, as described above, since the toner hardly interfuses into the lubricant material supplying device 60Y, the occurrence of such background fouling can be prevented.

The lubricant material supplying device 60Y is not necessarily provided outside the drum cleaning device 50Y. Also, the inner space of the casing 61Y is not necessarily sealed from the outside.

Further, in Embodiment No. 1, the sealing member 64Y is provided to the peripheral portion of the opening of the casing 61Y on the downstream side thereof relative to the rotation direction of the image bearing drum 2Y while in contact with the surface of the image bearing member 2Y all over along the axis direction of the image bearing drum 2Y. The sealing member 64Y is made of urethane rubber and the contact pressure thereof is almost uniform as to the direction perpendicular to the rotation direction of the image bearing drum 2Y. Since the sealing member 64Y has such a structure, the lubricant material on the surface of the image bearing drum 2Y is uniformly extended, thinned and evened out while passing the contact point of the sealing member 64Y even when the thickness of the lubricant material 62Y supplied by the agitator 63Y is not uniform on the surface of the image bearing drum 2Y. As a result, the lubricant material can be significantly uniformly attached all over the surface of the image bearing drum 2Y. In addition, it is possible to prevent the lubricant amount 62Y from excessively attaching to the surface of the image bearing drum 2Y by suitably controlling the contact pressure and the contact angle of the sealing member 64Y. Therefore, it is possible to restrain the amount of the lubricant material 62Y which interfuses into the drum cleaning device 50Y while maintaining the effect of the lubricant material 62Y such as restraint of friction of the surface of the image bearing drum 2Y and the cleaning blade 51Y. This leads to further restraint of the background fouling caused by the remaining toner reused after transfer. Further, since the amount of the lubricant material 62Y consumed per image formation can be restrained as least as possible, the amount of the lubricant material 62Y loaded in a printer beforehand can be reduced, which leads to promotion of the size reduction of the printer. In embodiment No. 1, the sealing member 64Y has a block form but can adopt another form such as plate.

Variant of Embodiment No. 1

Figure 3:
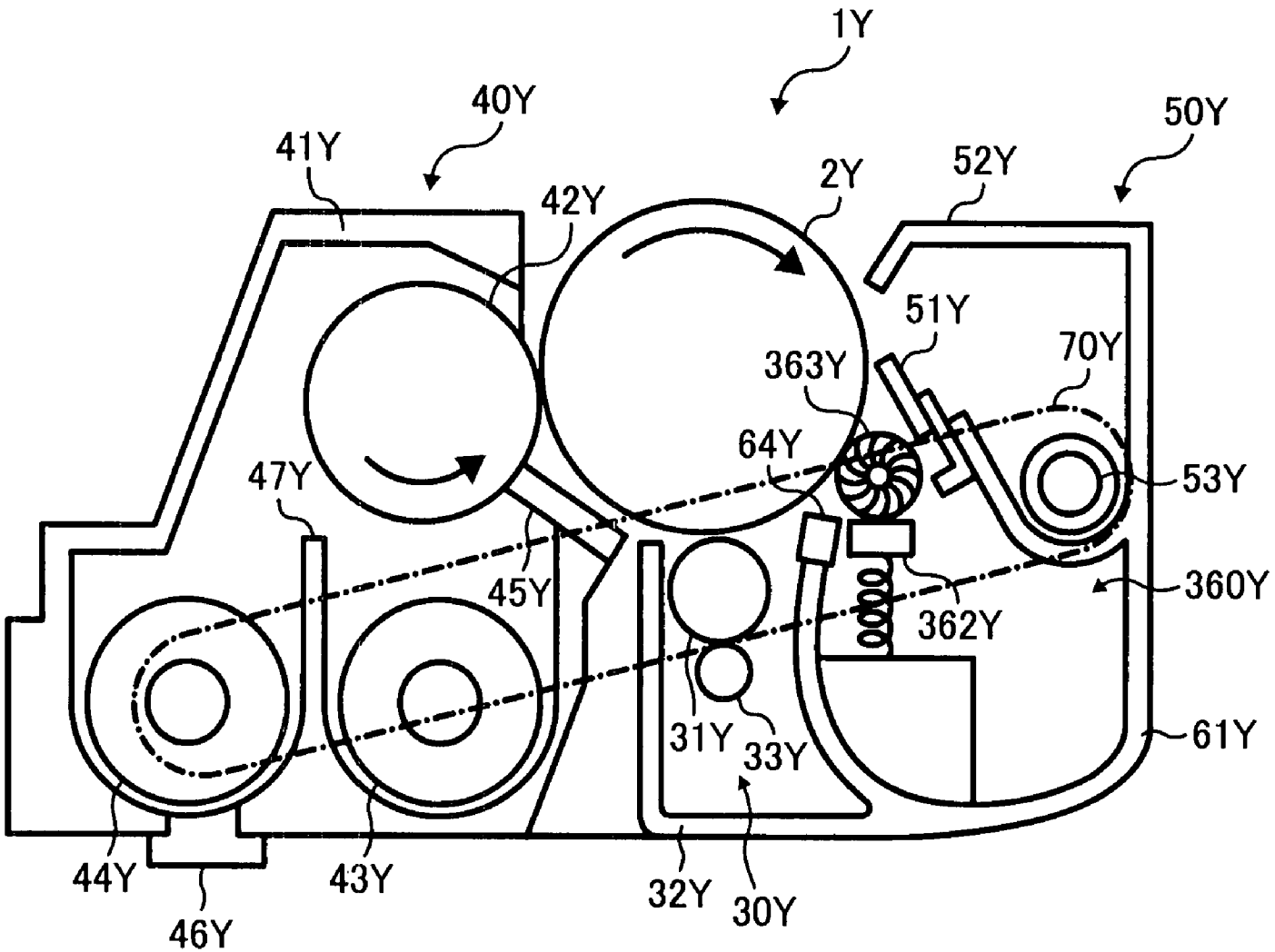
FIG. 3 is an enlarged schematic diagram illustrating another example of the image forming unit.

Next, a variant example of the lubricant material supplying device described in Embodiment No. 1 is described. FIG. 3 is an enlarged diagram illustrating a schematic structure of the image formation unit for yellow of the variant example.

The yellow image formation unit 1Y of the variant example has the same structure as in Embodiment No. 1 except that a brush roller 363Y functioning as the lubricant material supplying device rotates and supplies lubricant materials to the surface of the image bearing drum 2Y. A lubricant material supplying device 360Y of the variant example uses a solid lubricant material 362Y as the lubricant material. The solid lubricant material 362Y is scraped by abrasion of the brush roller 363Y and fine powdered lubricant material is obtained. This fine powdered lubricant material is attached to the brush roller 363Y. As the brush roller 363Y rotates, the attached lubricant material is conveyed to the area opposing the surface of the image bearing drum 2Y and supplied to the surface of the image bearing drum 2Y.

The lubricant material supplying device 360Y of the variant example is provided outside the drum cleaning device 50Y as is the lubricant material supplying device 60Y of Embodiment No. 1 described above. The inner space of the casing 61Y is also shielded from outside. Therefore, the same effect as that obtained by the lubricant material supplying device 60Y of Embodiment No. 1 can be obtained.

Embodiment No. 2

Next, as in Embodiment No. 1, another embodiment (Embodiment No. 2) in which the present invention is applied to a tandem type image forming apparatus as a printer is described. The basic structure of the printer in Embodiment No. 2 is the same as the corresponding structure of Embodiment No. 1. The same reference numerals as those in Embodiment No. 1 are used in Embodiment No. 2. Only the difference portions therebetween are described below.

Figure 4:
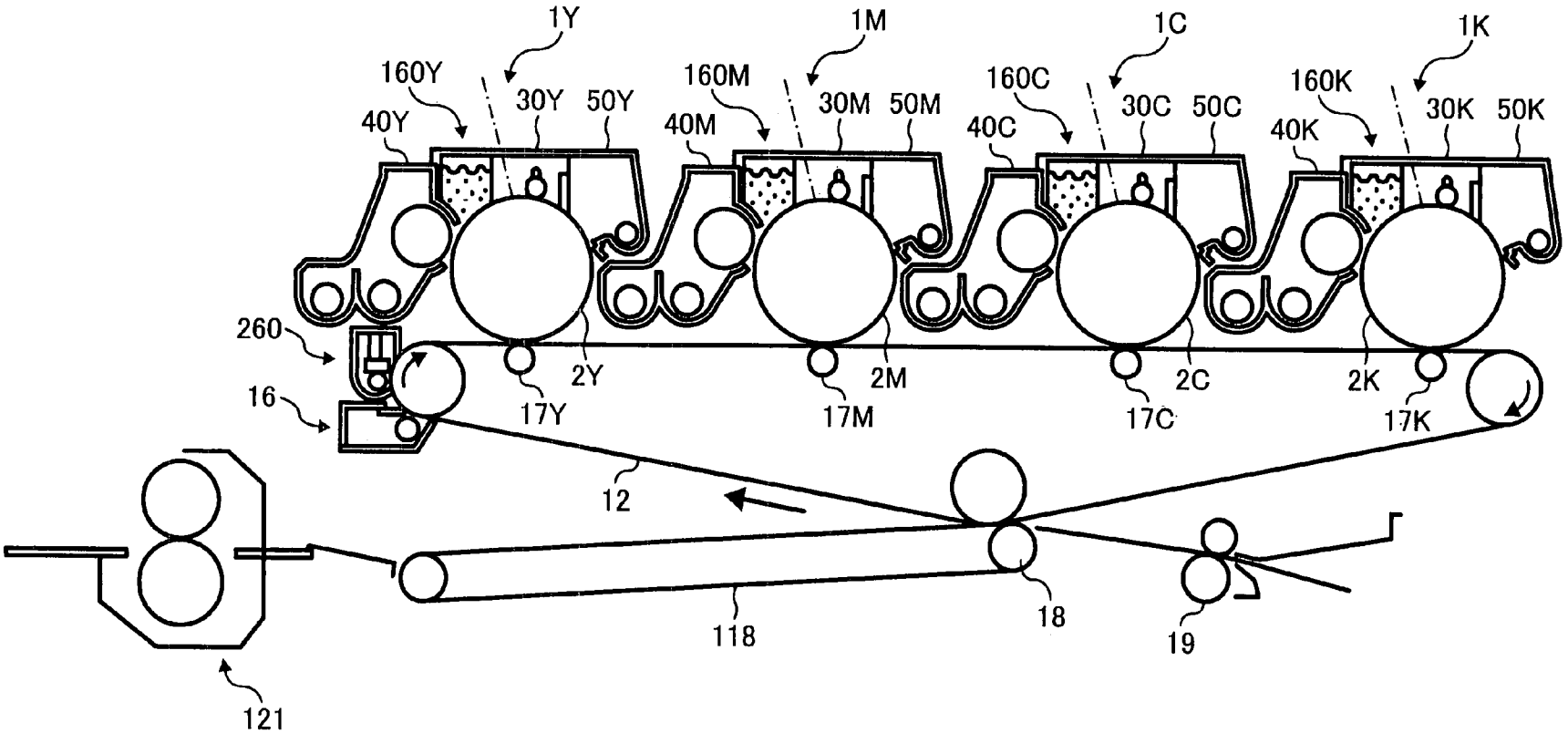
FIG. 4 is a schematic diagram illustrating an example of part of the image forming apparatus of the present invention.

FIG. 4 is a schematic structure diagram illustrating the primary portion of the printer of Embodiment No. 2. This printer adopts the same tandem system as in Embodiment No. 1. Each image formation unit 1Y, 1M, 1C and 1K is disposed perpendicularly above the intermediate transfer belt 12. This printer has a transfer medium conveying belt 118 functioning as a recording medium conveying device suspended over the secondary transfer bias roller 18 and a fixing unit 121 adopts a roller fixing system. The printer of Embodiment No. 2 includes lubricant material supplying devices 160Y, 160M, 160C and 160K to supply lubricant material as in Embodiment No. 1 and a lubricant material supplying device 260 to supply a lubricant material to the intermediate transfer belt 12.

Figure 5:
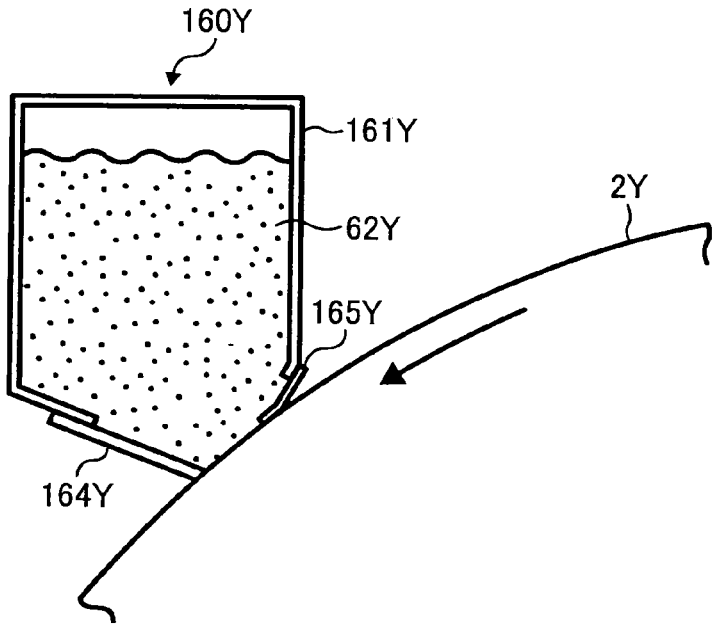
FIG. 5 is a schematic diagram illustrating an example of the lubricant material supplying device for supplying a lubricant material to the image bearing drum of the image forming apparatus of the present invention.

FIG. 5 is a schematic diagram illustrating a lubricant material supplying device 160Y to supply lubricant material to the image bearing drum 2Y. Other lubricant material supplying devices 160M, 160C, and 160K have the same structure. The lubricant material supplying device 160Y is perpendicularly above the surface of the image bearing drum 2Y where the lubricant material is supplied. In the inner space (sealed space) of a casing 161Y, the fine powdered lubricant material 62Y is accommodated. As illustrated in FIG. 4, the casing 161Y of the lubricant material supplying device 160Y of Embodiment No. 2 has an integral structure with the other casings of the charging device 30Y, the developing device 40Y and the drum cleaning device 50Y. The lubricant material supplying device 160Y, the charging device 30Y, the developing device 40Y, the drum cleaning device 50Y and the image bearing drum 2Y structure a process cartridge detachably attached to the main body of a printer. The inner space of each casing is separated from each other. The lubricant material supplying device 160Y is provided outside the drum cleaning device 50Y.

The lubricant material supplying device 160Y of Embodiment No. 2 is integrally structured with the casings of the charging device 30Y and the developing device 40Y, and has sealing devices 164Y and 165Y as illustrated in FIG. 5. The casing 161Y is open only to the side opposing the surface of the image bearing drum 2Y. The sealing device 165Y disposed on the upstream side of the surface of the image bearing drum 2Y and the sealing member 164Y disposed on the downstream side of the surface of the image bearing drum 2Y relative to the rotation direction of the image bearing drum 2Y form peripheral portion of the casing 161Y and are in contact with the surface of the image bearing drum 2Y therealong. As illustrated in Embodiment No. 1, a sealing device (not shown) contacts the peripheral portion of the opening at the end of the image bearing drum 2Y along the rotation direction of the image bearing drum 2Y. That is, the opening peripheral portion of the casing 161Y of the lubricant material supplying device 160Y are in contact with the surface of the image bearing drum 2Y in Embodiment No. 2 as well. The inner space of the casing 161Y is shielded from outside.

Figure 6:
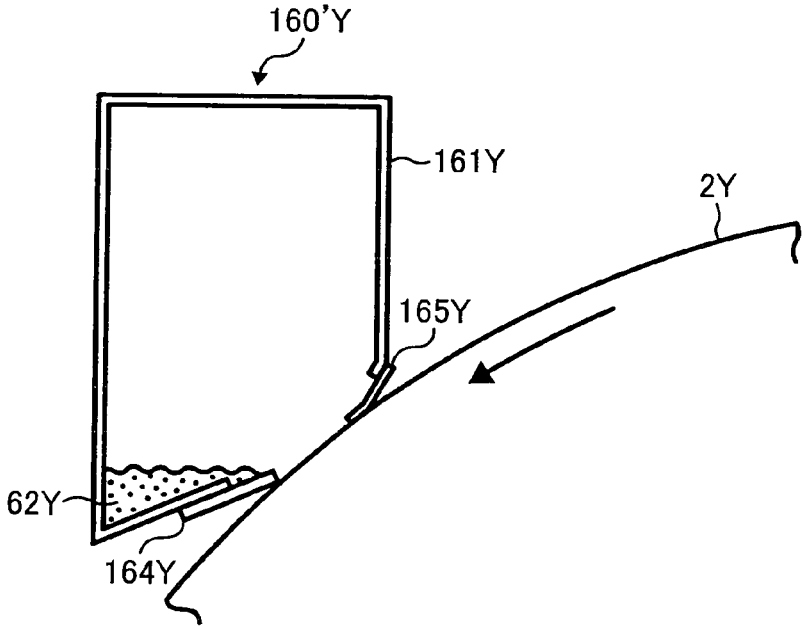
FIG. 6 is a schematic diagram illustrating an example of the structure of a lubricant material supplying device in which a lubricant material remains in its casing.

The lubricant material supplying device 160Y of Embodiment No. 2 is structured such that the lubricant material 62Y moves towards the surface of the image bearing drum 2Y along the inner wall of the casing 161Y by gravity. To be specific, the inner wall except the ceiling of the casing 161Y is structured such that the lubricant material 62Y moves downwards to the surface of the image bearing drum 2Y. As illustrated in FIG. 6, when the casing 161Y has a structure such that there is a portion where the lubricant material 62Y can accumulate, the accumulated lubricant material 62Y is not supplied to the surface of the image bearing drum 2Y. To the contrary, when the casing 161Y has the structure of Embodiment No. 2, the lubricant material accommodated in the casing 161Y can move to the surface of the image bearing drum 2Y by gravity as the lubricant material 62 is consumed. Therefore, the lubricant material 62Y can be used up. The structure in which the lubricant material 62Y in the inner space moves downward to the surface of the image bearing drum 2Y along the inner wall of the casing 161Y is still valid even when the lubricant material supplying device 160Y is not provided outside the drum cleaning device 50Y and/or the inner space of the casing 161Y is not shielded from outside.

Figure 7:
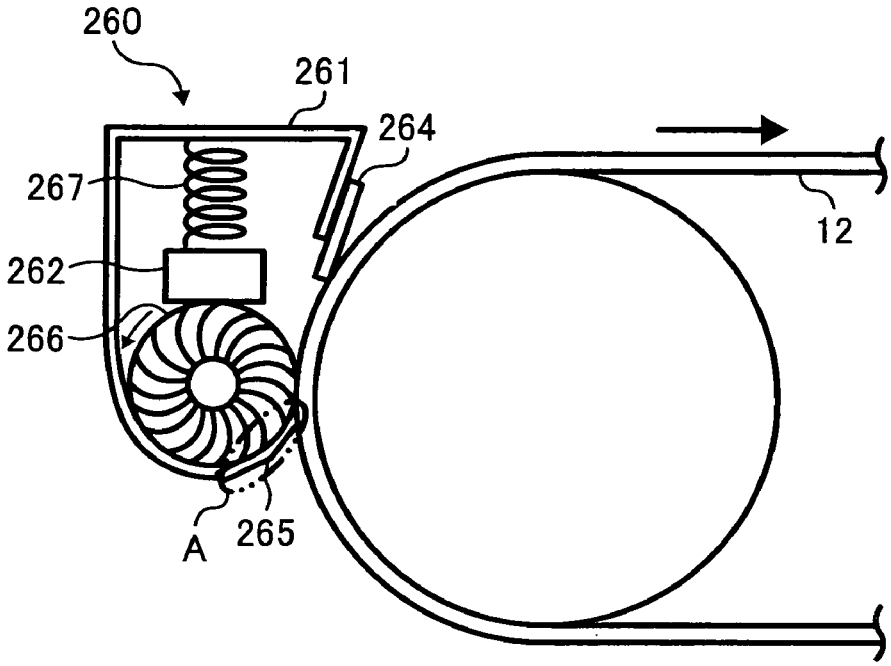
FIG. 7 is a schematic diagram illustrating an example of the lubricant material supplying device for supplying a lubricant material to an intermediate transfer belt.

FIG. 7 is a schematic diagram illustrating a lubricant material supplying device 260.

The lubricant material supplying device 260 is disposed substantially parallel to the surface of the intermediate transfer belt 12 functioning as a surface moving device to which a solid lubricant material 262 is supplied. In the inner space (shielded space) of a casing 261, there are provided a spring 267 as a bias device, the solid lubricant material 262 biased by the spring 267 and a rotating brush roller 266 to abrade the solid lubricant material 262 and the surface of the intermediate belt 12. When the rotating brush roller 266 rotates in the lubricant material supplying device 260, the solid lubricant material is abraded by the brush roller 266. Fine powder produced by abrading the solid lubricant is attached to the surface of the intermediate transfer belt 12. The lubricant material supply in device 260 is provided outside the belt cleaning device 16 as described in the case of the lubricant material supplying device 160Y for use in the image bearing drum 2Y. The casing 261Y has a structure having an inner space shielded from outside.

Different from the lubricant material supplying device 160Y for use in the image bearing drum 2Y, the lubricant material supplying device 260 has a portion (e.g., a slanting portion A) where the solid lubricant material 262Y can accumulate as illustrated in FIG. 7. Therefore, when the brush roller 266 abrades the solid lubricant material 262 and the abraded solid lubricant material scatters and accumulates in the portion, the accumulated solid lubricant material may not be able to move towards the surface of the intermediate transfer belt 12 against gravity. Such lubricant material stays in the inner wall forming the bottom part of the lubricant material supplying device 260 and is not supplied to the surface of the intermediate transfer belt 12 unless the brush roller 266 picks up the lubricant material. That is, since the powdered accumulated lubricant material may not be supplied to the surface of the intermediate transfer belt 12, the lubricant material in the casing 261 is not used up. The lubricant material supplying device 260 has a structure such that the brush roller 266 abrades the inner wall of the portion of the casing 261 which forms the bottom part of the lubricant material supplying device 260 where the powdered lubricant material accumulates. Therefore, the powdered lubricant material does not stay in the inner space and can be used up. The structure in which a brush roller abrades the inner wall of the casing where the powdered lubricant material accumulates is valid even when the lubricant material supplying device 260 is not provided outside the belt cleaning device 16 and/or the inner space of the casing 261 is not shielded from outside.

As in the case of lubricant material supplying device 160Y for use in the image bearing drum 2Y of Embodiment No. 2, the structure in which the lubricant material 62Y in the inner space moves downwards to the surface of the image bearing drum 2Y along the inner wall of the casing 161Y by gravity is effective not only for the powdered lubricant material but also a liquid lubricant material. In addition, the structure is also effective to the case of the lubricant material supplying device 260 for use in the intermediate transfer belt 12 in which the brush roller 266 scrapes and supplies the solid lubricant material 262 and the scraped lubricant material is supplied by the brush roller 266.

In addition, in Embodiment No. 2, the lubricant material supplying position of the lubricant material supplying device 160Y for use in the image bearing drum 2Y is positioned on a further downstream side from the uniform charging position (contact position of the charging roller 31Y) of the charging device 30Y relative to the rotation direction of the image bearing drum 2Y. When the amount of the lubricant material 62Y attached to the charging roller 31Y is too large, the current from the charging roller 31Y to the image bearing drum 2Y decreases, which may lead to deterioration of charging. In Embodiment No. 2, as described above, the lubricant material 62Y is supplied at the position which is on the downstream side of the uniform charging position of the charging device 30Y relative to the rotation direction of the image bearing drum 2Y. Thereby, the lubricant material 62Y attached to the surface of the image bearing drum 2Y reaches the uniform charging position of the charging device 30Y via the development area, the primary transfer area and the cleaning area as the image bearing drum 2Y rotates.

Some of the lubricant material 62Y on the image bearing drum 2Y is retrieved by the developing device 40Y in the developing area, by the intermediate transfer belt 12 in the primary transfer area, and by the cleaning blade 51Y in the cleaning area. The amount of the lubricant material 62Y on the image bearing drum 2Y supplied from the lubricant material supplying device 160Y decreases before the uniform charging position.

Therefore, the amount of the lubricant material 62Y attached to the charging roller 31Y can be restrained to be extremely small, thereby restraining the deterioration of charging. When a non-contact type charging system such as a corona charger is adopted, a problem involving with lubricant materials hardly occurs. However, as described above, a contact type charging system has advantages such as uniform charging and less production of ozone in comparison with a non-contact type charging system. In the case of the lubricant material supplying position as in Embodiment No. 2, deterioration of charging can be restrained as described above. As a result, a contact type charging system, which has advantages over a non-contact type charging system, can be adopted as the structure having a system supplying the lubricant material 62Y. The structure having such a lubricant material supplying position of a lubricant material supplying device is effective even when the lubricant material supplying device 160Y is not provided outside the drum cleaning device 50Y and the inner space of the casing 161Y is not shielded from outside.

In Embodiments Nos. 1 and 2, the lubricant material supplying devices 60Y and 161Y are integrally structured with the image bearing drum 2Y, etc. to form a process cartridge detachably attached to the main body of a printer. It is also possible to simply structure the lubricant material supplying devices 60Y and 160Y detachably attached to the main body of a printer. With this structure, the replacement of the lubricant material supplying devices 60Y and 160Y can be set irrespective of the life of the image bearing drum 2Y. Thereby, it is possible to increase the latitude of designing the lubricant material supplying devices 60Y and 160Y. For example, when the amount of the lubricant material accommodated in the device is reduced, the dimensions of the lubricant material supplying devices 60Y and 160Y can be small, which leads to the size reduction thereof. On the other hand, when the amount of the lubricant material accommodated in the device is increased, the dimensions of the lubricant material supplying devices 60Y and 160Y can be large, which leads to decrease of the frequency of replacement of the lubricant material supplying devices 60Y and 160Y. The structure in which simply the lubricant material supplying devices 60Y and 160Y are detachably attached to the main body of a printer is effective even when the lubricant material supplying devices 60Y and 160Y are not provided outside the drum cleaning device 50Y and/or the inner space of the casings 61Y and 161Y are not shielded from outside.

The printers described in Embodiments 1 (including Variant Example) and 2 include the drum cleaning device 50Y or the belt cleaning device 16 functioning as a cleaning device to retrieve the remaining (unnecessary) toner attached to the surface of the image bearing drum 2Y and the intermediate transfer belt 12 functioning as surface moving devices. In addition, the lubricant material supplying devices 60Y, 160Y and 260 are provided on the surface of the image bearing drum 2Y, etc. to supply lubricant materials to reduce the friction coefficient between the surface of the image bearing drum 2Y and the material (e.g., toner, magnetic carrier and cleaning blade 51Y) contacting the surface. The lubricant material supplying devices 60Y, 160Y and 260 are provided outside the drum cleaning device 50Y, etc. Further, the lubricant material supplying devices 60Y, 160Y and 260 include the casings 61Y, 161Y and 261, respectively. These casings have an opening that is open only to the side opposing the surface of the image bearing drum 2Y, etc., and contacts the peripheral portions of the opening to the image bearing drum 2Y, etc. The lubricant material is accommodated and supplied in the shielded space surrounded by the inner wall of the casings and the surface portion of the image bearing drum 2Y, etc. By having such a structure, all the lubricant material can be supplied to the image bearing drum 2Y, etc. and is not wasted. Further, the size of the devices can be reduced.

The lubricant material supplying device 160Y for the image bearing drum 2Y of Embodiment No. 2 has a structure in which the lubricant material 62Y having fluidity in the inner space (shielded space) of the casing 161Y moves towards the surface of the image bearing drum 2Y forming part of the inner space along the inner wall of the casing 161Y by gravity. Therefore, as described above, all the lubricant material 62Y can be used up without remaining in the casing 161Y.

The lubricant material supplying device 260 for the intermediate transfer belt 12 of Embodiment No. 2 includes the solid lubricant material 262 and the rotating brush roller 266 to abrade the solid lubricant material 262 and the intermediate transfer belt 12. The lubricant material supplying device 260 scrapes the solid lubricant material 262 by the brush roller 266 and supplies the scraped lubricant material to the surface portions of the inner space of the casing 261. In addition, the lubricant material supplying device 260 has a structure in which the brush roller 266 abrades the inner wall portion of the casing 261 where the scraped lubricant material can accumulate. By having such a structure, the lubricant material can be used up without remaining in the casing 261.

The lubricant material supplying devices 60Y and 160Y for the image bearing drum 2Y of Embodiments No. 1 and 2 described above have a lubricant material supplying position for the surface of the image bearing drum 2Y on the downstream side of the cleaning position of the drum cleaning device 50Y for the image bearing drum 2Y and on the upstream side of the toner attachment position (development area) on the surface of the image bearing drum 2Y relative to the rotation direction of image bearing drum 2Y. Also, the lubricant material supplying device 260 for the intermediate transfer belt 12 of Embodiment No. 2 has a lubricant material supplying position for the surface of the intermediate transfer belt 12 on the downstream side of the cleaning position of the belt cleaning device 16 for the image intermediate transfer belt 12 and on the upstream side of the toner attachment position (primary transfer area) on the surface of the intermediate transfer belt 12 relative to the rotation direction of intermediate transfer belt 12. Therefore, as described above, toner hardly mingles into the lubricant material supplying devices 60Y, 160Y and 260 so that the occurrence of the background ascribable to the mingled toner can be prevented.

In addition, the printer of Embodiment No. 2 includes the image bearing drum 2Y functioning as an image bearing member, the charging device 30Y, the optical writing unit 10 functioning as a latent image forming device, the developing device 40Y, the secondary transfer bias roller 18 functioning as a transfer device. The charging device 30Y has the charging roller 31Y disposed in contact with or in the vicinity of the image bearing drum 2Y. The charging roller 31Y uniformly charges the surface of the image bearing drum 2Y, which is cleaned by the drum cleaning device 50Y. The optical writing unit 10 functions as a latent image forming device for forming a latent image on the surface which is uniformly charged by the charging device 30Y. The developing device 40Y functions as a developing device to develop the latent image formed on the surface of the image bearing drum 2Y with toner. The primary transfer bias roller 17Y functions as a transfer device for transferring the toner image formed on the image bearing drum 2Y by the developing device 40Y to the intermediate transfer belt 12 as a transfer medium. The lubricant material supplying device 160Y for the image bearing drum 2Y is disposed in such a manner that the lubricant material supplying position is on the downstream side of the uniformly charging position of the charging device 30Y relative to the rotation direction of the image bearing drum 2Y. Therefore, as described above, the amount of the lubricant material 62Y attached to the charging roller 31Y of the charging device 30Y can be restrained so that the deterioration of the charging can be restrained. As a result, as described above, a contact type charging system having advantages over a non-contact type charging system can be adopted for an image forming apparatus to which the lubricant material 62Y is supplied.

In addition, the lubricant material supplying devices 60Y, 160Y and 260 of Embodiments Nos. 1 and 2 have sealing members 64Y, 164Y and 264, respectively, which can contact with the surface of the image bearing drum 2Y (or, in the case of member 264, belt 12) with a uniform pressure in the direction perpendicular to the rotation direction of the image bearing drum 2Y. The sealing members 64Y, 164Y and 264 are disposed on the downstream side of the lubricant supplying material position to the surface of the image bearing drum 2Y (or belt 12) relative to the rotation direction of the image bearing drum 2Y (or direction of movement of belt 12). Thereby, the lubricant material can be significantly uniformly attached to all over the surface area of the image bearing drum 2Y (or belt 12). In addition, by suitably controlling the contact pressure and the contact angle of the sealing members 64Y, 164Y and 264, it is possible to prevent the lubricant material from being attached to the surface of the image bearing drum 2Y (or belt 12) in an excessive amount. Consequently, the amount of the lubricant material preliminarily accommodated in a printer can be small, which leads to promotion of the size reduction of the device.

Further, the printer of Embodiments No. 1 and 2 described above includes the recycled toner conveying device 70Y as a toner recycling device for reusing the retrieved remaining toner for image formation. Therefore, a system friendly to the environment by reducing the amount of waste toner can be provided. In addition, there is another effect in that the life regulated by the amount of waste toner in a waste toner container can be relaxed. Especially, as in Embodiment No. 1 described above, when the lubricant material supplying device 60Y is disposed such that the lubricant material supplying position is disposed in the vicinity of the cleaning position of the drum cleaning device 50Y on the downstream side relative to the rotation direction of the image bearing drum 2Y, the lubricant material does not easily interfuse into the drum cleaning device 50Y. Therefore, even an image forming apparatus having a mechanism which supplies the lubricant material 62Y having an adverse effect on friction charging of toner to the image bearing drum 2Y can adopt a toner recycling device for reusing the remaining toner retrieved at the drum cleaning device 50Y while sufficiently restraining the occurrence of background fouling. The structure of an image forming apparatus in which the lubricant material 62Y having an adverse effect on friction charging of toner is supplied to the image bearing drum 2Y and a toner recycling device is used is valid even when the lubricant material supplying device 160Y is not provided outside the drum cleaning device 50Y and the inner space of the casing 161Y is not shielded from outside.

As described above, when the lubricant material supplying devices 60Y, 160Y and 260 are simply detachably attached to the main body of a printer, the timing of replacement thereof can be freely set irrespective of the life of other devices such as the image bearing drum 2Y. In addition, it is possible to increase the latitude of designing the lubricant material supplying device.

In addition, in Embodiments No. 1 and 2, a process cartridge is adopted which is detachably attached to the main body of a printer and integrally has at least the image bearing drum 2Y and the lubricant material supplying devices 60Y and 160Y. This contributes to the convenience for a user in terms of the replacement of the image bearing drum 2Y and the lubricant material supplying devices 60Y and 160Y. Especially, since the lubricant material is supplied to the surface of the image bearing drum 2Y in the structures in Embodiments No. 1 and 2, the life of the image bearing drum 2Y, which is the shortest among those of the devices, can be elongated. Therefore, the frequency of the replacement of the process cartridge can be reduced so that the convenience for a user is further improved. Further, since the remaining toner is reused in the developing device 40Y in the structure in Embodiments No. 1 and 2, the frequency of the replacement of a toner container can be reduced. Therefore, the frequency of the replacement of the process cartridge including such a toner container can be reduced. Further, since each image formation unit 1Y, 1M, 1C and 1K has its own process cartridge, that is, 4 process cartridges in total, in Embodiments No. 1 and 2, the reduction of the frequency of the replacement is especially effective.

A two-component developer is used in Embodiments Nos. 1 and 2 described above but the present invention can have the same effect when a single-component developer is used. Also, the present invention can be applied not only to a tandem system image forming apparatus but also an image forming apparatus having a single image bearing drum which sequentially overlaps each color toner image sequentially formed on the single image bearing drum to form a color image. In addition, the present invention can be applied to a monochrome image forming apparatus as well as a color image forming apparatus. Other image forming apparatuses such as a photocopier and a facsimile machine are also in the scope of the present invention.

The structure of the lubricant material supplying devices 60Y, 160Y and 260 described in Embodiments Nos. 1 and 2 can be applied to a lubricant material supplying device for a surface moving device such as a transfer medium conveyer belt 118 other than the image bearing drum 2Y and the intermediate transfer belt 12.

Figure 9:
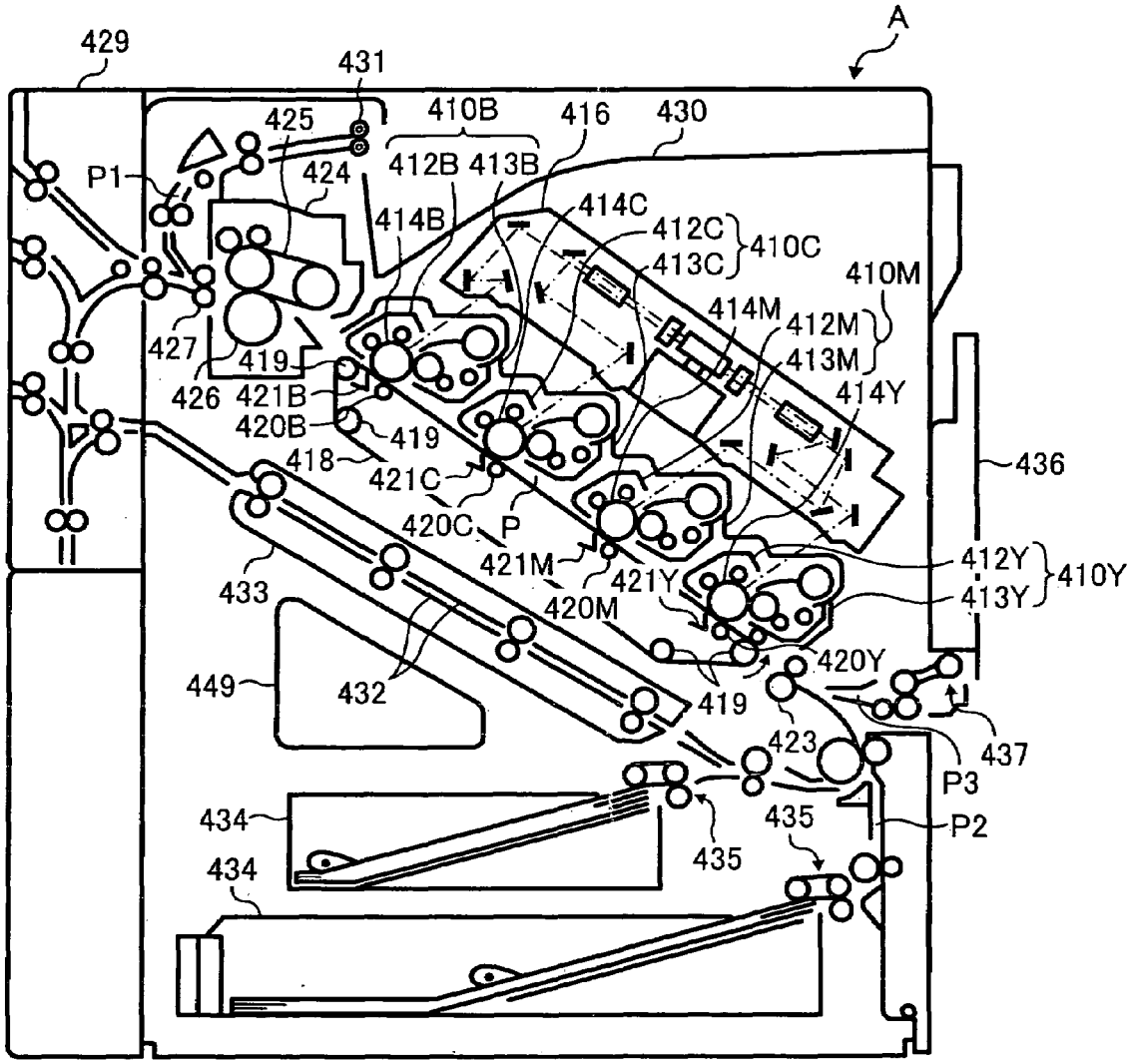
FIG. 9 is a schematic diagram illustrating another example of the image bearing member of the present invention.

FIG. 9 is a schematic diagram illustrating a small-sized color printer, which is one embodiment of the image forming apparatus of the present invention.

Character A in FIG. 9 represents the entire body of the printer. There is provided a transfer medium path P disposed from the bottom right side to the top left side in a diagonal way in the printer A.

On the transfer medium path P, four single color image formation units (i.e., a tandem type) 410Y, 410M, 410C and 410*b* for yellow, magenta, cyan and black, respectively, are arranged in this order along the transfer medium path P from the bottom right side to top left side. Each single color image formation unit 410Y, 410M, 410C and 410B includes image bearing member units 412Y, 412M, 412C and 412B and developing units 413Y, 413M, 413C and 413B, respectively. Each single color image formation unit 410Y, 410M, 410C and 410B is detachably attached to the printer A. As described in detail later, each image bearing member unit 412Y, 412M, 412C and 412B includes image bearing drums 414Y, 414M, 414C and 414B having a drum form, respectively.

Above the single color image formation units 410Y, 410M, 410C and 410B, a writing unit 416 is provided therealong in a diagonal way, which is described later in detail.

Below the single color image formation units 410Y, 410M, 410C and 410B, a transfer medium bearing member 418 having an endless form is suspended with the transfer medium path P therebetween. The transfer medium bearing member 418 is suspended over four supporting rollers 419 in this illustrated example while contacting the image bearing members 414Y, 414M, 414C and 414B. Part of the transfer medium bearing member 418 is provided along the transfer medium path P and driven counterclockwise by a driving device (not shown).

Inside the transfer medium bearing member 418, backup rollers 420Y, 420M, 420C and 420B and transfer brushes 421Y, 421M, 421C and 421B are disposed to the respective image bearing members 414Y, 414M, 414C and 414B. The backup rollers 420Y, 420M, 420C and 420B make the transfer medium bearing member 418 and a transfer medium tightly attach to the image bearing members 414Y, 414M, 414C and 414B. In addition, a transfer bias is applied to the transfer brushes 421Y, 421M, 421C and 421B by a power source (not shown). The transfer brushes are used in the illustrated example but a non-contact type charger can be also used.

Along the transfer medium path P, a pair of registration rollers 423 are provided on the upstream side of the transfer medium bearing member 418 relative to the rotation direction thereof and a fixing unit 424, on the downstream side thereof. The fixing unit 424 includes a fixing belt 425 having an endless form, a pressing roller 426 pressing the fixing belt 425 and a pair of discharging rollers 427 disposed at the exit.

On the downstream side of the fixing unit 424, there is provided a reversing unit 429 which is attached to the printer A. The reversing unit 429 discharges or reverses a transfer medium and returns the transfer medium to the printer A.

In addition, on the downstream side of the fixing unit 424, a reversing discharging path P1 is provided branching from the transfer medium path P and ahead thereof a pair of discharging rollers 431 are provided to discharge a transfer medium to a discharged medium stack 430 disposed at the upper portion of the printer A.

Below the transfer medium bearing member 418, a transfer medium re-feeding unit 433 is provided to re-feed a transfer medium reversed at the reversing unit 429 while guiding the transfer medium through a pair of guiding boards 432.

Below the transfer medium re-feeding unit 433, two feeding cassettes are provided above and below. In the feeding cassettes 434, transfer media such as paper and transparent sheets of varying sizes are accommodated. A transfer medium feeding portion 435 is provided to separate and feed a transfer medium one by one.

On the right hand side of the transfer medium feeding portion 435, a transfer medium path P2 is provided to guide a transfer medium fed from the transfer medium feeding portion 435 and re-fed through the transfer medium re-feeding unit 433 to the pair of registration rollers 423 of the transfer medium path P.

On the right hand side of the printer A, a manual feeder is provided and a manual feeder tray 436 which can be open and closed is attached thereto. The manual feeder includes a transfer medium feeding portion 437 to separate and feed transfer media on the manual feeder tray 436 one by one and a transfer medium path P3 is provided to guide the transfer medium fed from the transfer medium feeding portion 437 to the pair of registration rollers 423.

An image is recorded on a transfer medium using this color printer, for example, as follows. The transfer medium feeding portion 435 is selectively driven based on signals from, for example, a home computer and a PC; and the transfer media in the transfer medium feeding cassette 434 are separated and fed one by one to the transfer medium path P2 and bumped and stopped at the pair of the registration rollers 423. Or the transfer medium feeding portion 437 is driven; and the transfer media oh the manual feeder tray 436 are separated and fed one by one to the transfer medium path P3 and bumped and stopped at the pair of the registration rollers 423. In each single color image formation unit 410Y, 410M, 410C and 410B, corresponding single toner images of yellow, magenta, cyan and black are formed on each image bearing member 414Y, 414M, 414C and 414B while each image bearing member 414Y, 414M, 414C and 414B individually rotates. Simultaneously, one of the supporting rollers 419 is rotationally driven by a driving motor (not shown) to rotate the rest of the supporting rollers 419, thereby transferring the transfer medium bearing member 418. The pair of registration rollers 423 are rotated to the timing of the rotation of the image bearing members. The transfer medium is guided into the transfer medium path P and transferred to between the single color image formation devices 410Y, 410M, 410C and 410B and the transfer medium bearing member 418. With the transfer of the transfer medium, the single color toner images on individual image bearing members 414Y, 414M, 414C and 414B are transferred by the transfer brushes 421Y, 421M, 421C and 421B to record an overlapped full color image on the transfer medium.

The transfer medium is sent to the fixing unit 424 after the image is transferred thereto. Subsequent to fixing the transferred image, the transfer medium is discharged to the pair of discharging rollers 427. When the transfer medium is discharged with face down, the transfer medium is guided by a switching claw (not shown) to the reversing discharging path P1, discharged by the pair of the discharging rollers 431 and stacked on the discharged medium stack 430. When the transfer medium is discharged with face up, the transfer medium is guided by a switching claw (not shown) to the reversing unit 429 and discharged as it is.

On recording on a transfer medium on which an image is recorded on its one side, the transfer medium is guided by a switching claw (not shown) to the reversing unit 429, where the transfer medium is reversed. The transfer medium is guided to the transfer medium re-feeding unit 433, returned to the transfer medium path P2 and bumped and stopped at the pair of registration rollers 423.

The transfer medium is again guided to the transfer medium path P and transferred to between the single color image formation units 410Y, 410M, 410C and 410B and the transfer medium bearing member 418. An overlapped full color image is recorded on the reverse side of the transfer medium and fixed by the fixing unit 424. Thereafter, for example, the transfer medium is discharged by the pair of discharging rollers 431 through the reversing discharging path P1 and stacked on the discharged medium stuck 430.

Next, individual single color image formation units 410Y, 410M, 410C and 410B are described in detail.

Figure 10:
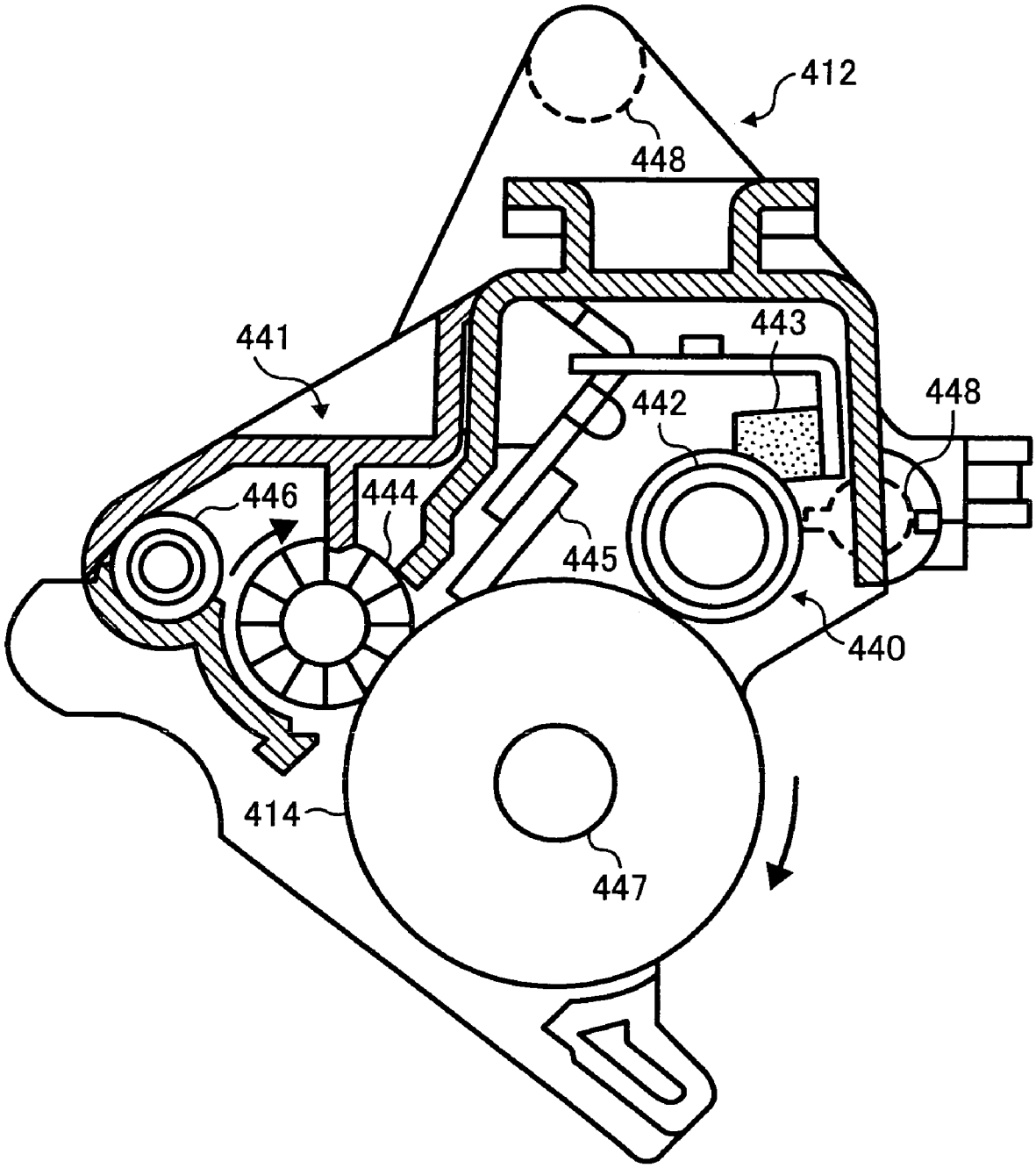
FIG. 10 is a cross section illustrating an example of the image bearing member unit for use in the image forming apparatus of the present invention.

In each image bearing member unit 412Y, 412M, 412C and 412B of each single color image formation units 410Y, 410M, 410C and 410B, as illustrated in FIG. 10, a charging device 440 and a cleaning device 441 are provided around an image bearing member 414 (414Y, 414M, 414C and 414B).

The charging device 440 includes a charging member 442 having a roller form disposed in the vicinity of the image bearing member 414 and applies a charging bias to between the charging member 442 to charge the image bearing member 414. A cleaner 443 is disposed in contact with the charging member 442 made of sponge, etc., to clean the surface thereof. In the illustrated example, the charging member 442 has a roller form but can be a known non-contact type charger.

The cleaning device 441 includes a fur brush 444 which can freely rotate while the outer circumference thereof is in contact with the image bearing member 414 and a cleaning blade 445 made of polyurethane rubber the end of which is pressed against the image bearing member 414. In FIG. 10, numeral 446 represents a retrieving screw.

The fur brush 444 is rotated in the counter direction to the rotation direction of the image bearing member 414. The toner remaining on the image bearing member is removed after image transfer. Thereafter, the toner still remaining on the image bearing member 414 is scraped and removed by the cleaning blade 445. The toner removed by the fur brush 444 and the cleaning blade 445 is discharged from the individual image formation units 410Y, 410M, 410C and 410B by the rotation of the retrieving screw 46 in the illustrated example. The removed toner passes a waste toner path (not shown) provided to the printer A and is transferred to a waste toner bottle 449.

Each image bearing unit 412 includes two portions which are a portion 447 functioning as the main benchmark and a portion 448 functioning as subsidiary benchmark so that the image bearing unit 412 can be accurately positioned and assembled in the printer A.

Each developing unit 413Y, 413M, 413C and 413B functioning as a developing device of the individual single color image formation units 410Y, 410M, 410C and 410B can use a single-component developer. But a two-component developer containing a magnetic carrier and a non-magnetic toner is used in the illustrated example. As the non-magnetic toner, the developing units 413Y, 413M, 413C and 413B use yellow, magenta, cyan and black, respectively.

In individual image forming units 410Y, 410M, 410C and 410B, the charging device 440 uniformly charges the surface of the image bearing member 414 by applying a charging bias with the clockwise rotation of the image bearing member 414 illustrated in FIG. 10 Next, the writing unit 416 scans the surface of the image bearing member with light to perform writing and a latent electrostatic image is formed thereon. The developing unit 413 (413Y, 413M, 413C and 413B) develops the latent electrostatic image with a toner to form a single toner image on the image bearing member.

Single color toner images of yellow, magenta, cyan and black are formed on the image bearing member 414Y of the single color image formation unit 10Y, the image bearing member 414M of the single color image formation unit 410M, the image bearing member 414C of the single color image formation unit 410C and the image bearing member 414B of the single color image formation unit 10B, respectively.

Each developing unit 413 has its own toner density detection sensor (not shown).

Next, the writing unit 416 is described in detail.

Figure 11:
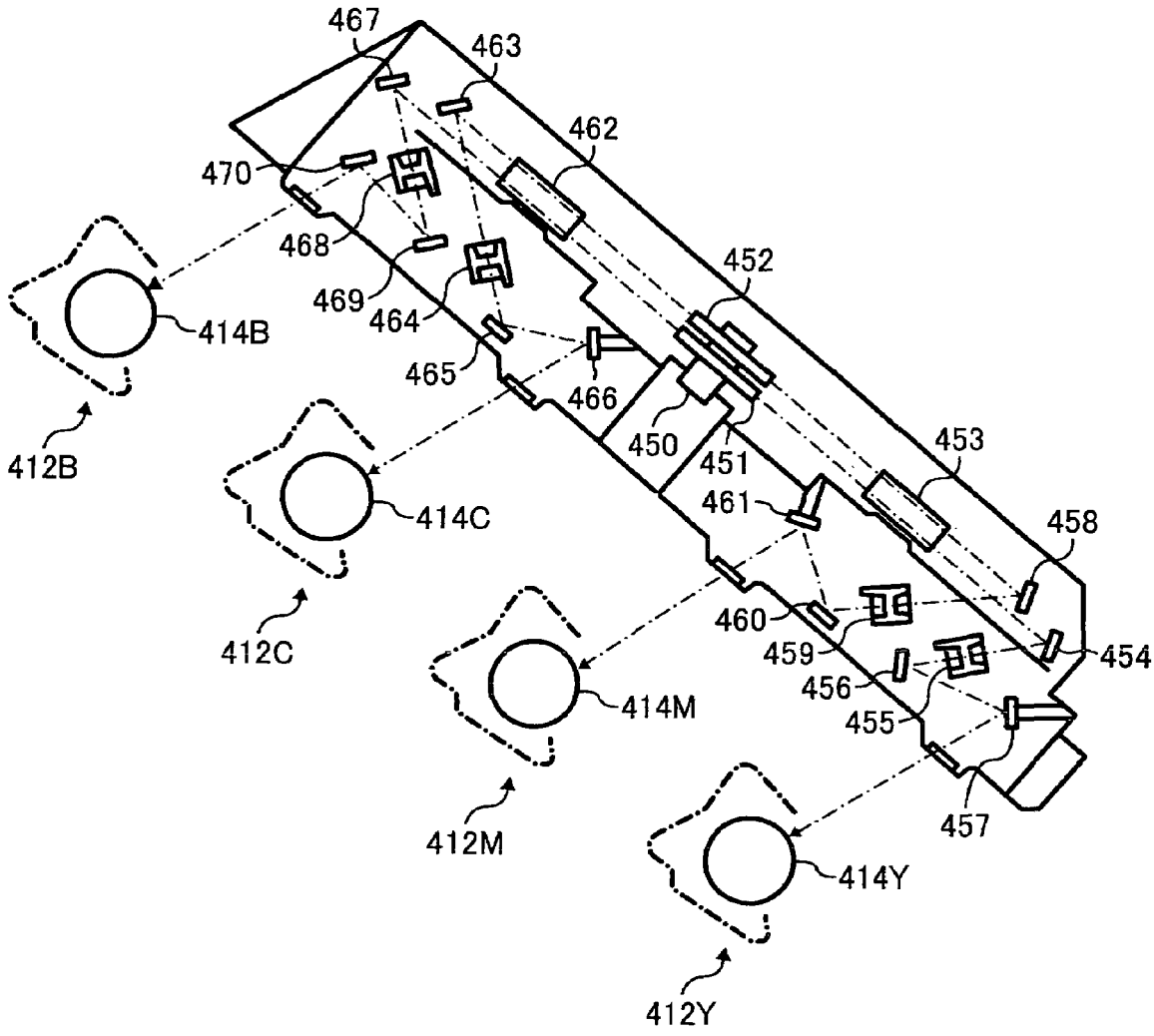
FIG. 11 is a schematic diagram illustrating an example of the writing unit for use in the image forming apparatus of the present invention.

As illustrated in FIG. 11, the writing unit 16 includes two polygon mirrors 451 and 452 having six faces which can be rotationally driven by a polygon mirror 450. The polygon mirrors 451 and 452 rotate and reflect the light irradiated from a laser diode (not shown) and separate the light into scanning light for yellow, magenta, cyan and black.

The scanning light for yellow passes through an fθ lens 453, is reflected at a mirror 454, passes through a long barrel toroidal lens (BTL) 455, is reflected at mirrors 456 and 457 and scans the surface of the image bearing member 414Y of the image bearing member unit 412Y.

The scanning light for magenta passes through the fθ lens 453, is reflected at a mirror 458, passes through a long barrel toroidal lens (BTL) 459, is reflected at mirrors 460 and 461 and scans the surface of the image bearing member 414M of the image bearing member unit 412M.

The scanning light for cyan passes through an fθ lens 462, is reflected at a mirror 463, passes through a long barrel toroidal lens (BTL) 464, is reflected at mirrors 465 and 466 and scans the surface of the image bearing member 414C of the image bearing member unit 412C.

The scanning light for black passes through the fθ lens 462, is reflected at a mirror 467, passes through a long barrel toroidal lens (BTL) 468, is reflected at mirrors 469 and 470 and scans the surface of the image bearing member 414B of the image bearing member unit 412B.

Figure 13:
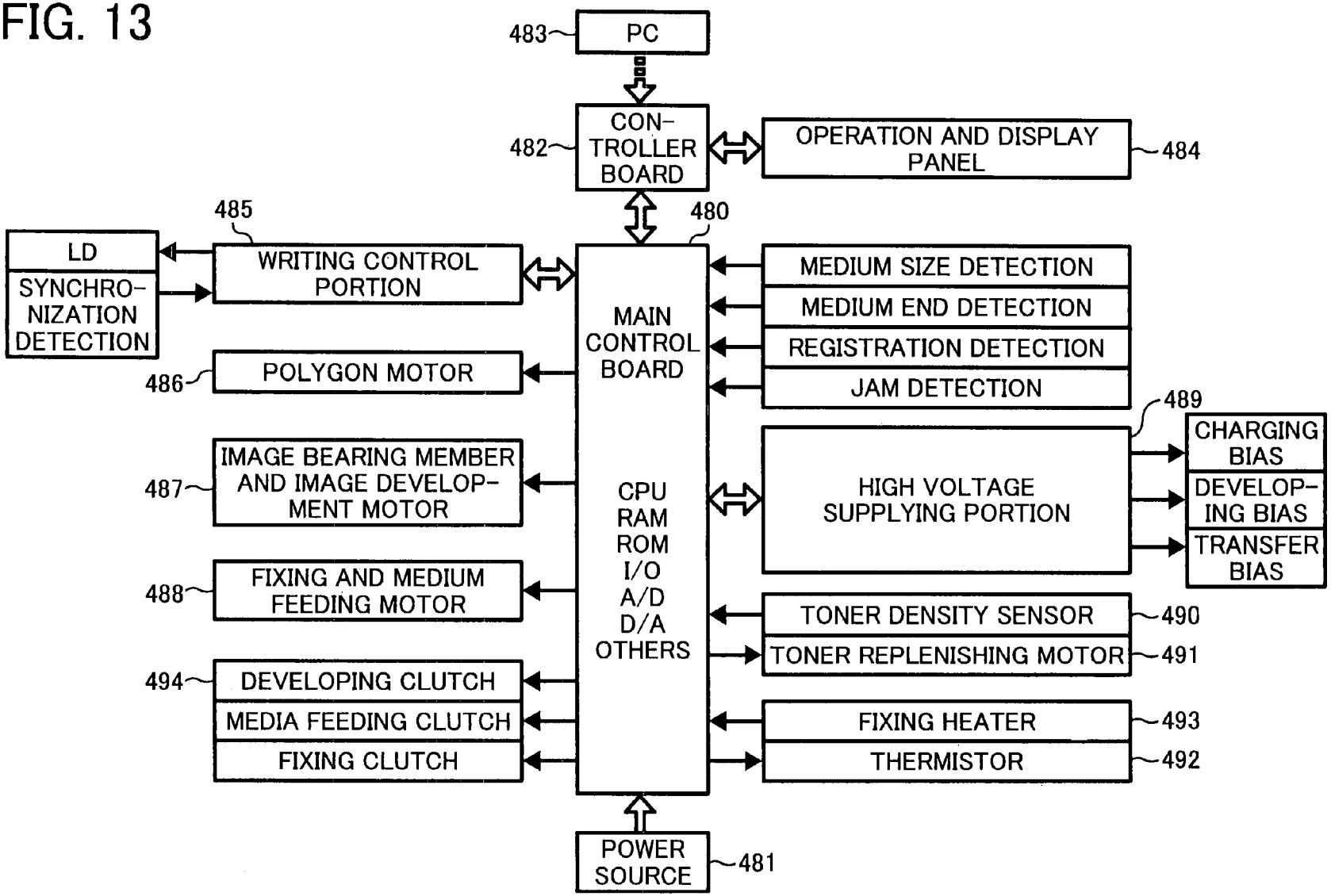
FIG. 13 is a block chart illustrating an example of the control of the image forming apparatus of the present invention.

FIG. 13 is a schematic diagram illustrating a control block chart of the printer A.

As seen in FIG. 13, a main control board 480 is provided in the printer. A power source 481 supplies power to the main control board 480 and the main control board 480 is connected to a PC (personal computer) 483 through network, etc., via a controller board 482. An operation and display panel 484 is connected to the controller board 482.

The main control board 480 is connected to, for example, a writing control portion 485. The main control board 480 controls the writing unit 416 and drives a polygon motor 486 thereof, and drives an image bearing member/image development driving motor 487 which drives the image bearing member 414 and the developing device 413. Further, the main control board 480 drives a fixing/medium feeding driving motor 488 to drive the fixing unit 424 and the rollers for use in medium feeding and turns on and off clutches such as developing clutch 494, media feeding clutch and a fixing clutch. The writing control portion controls laser diode and a synchronization detector.

In addition, the main control board 480 functions detection sensors such as medium size detector, a medium end detector, a registration detector and a medium jam detector and controls a high voltage supplying portion 489 to apply biases such as charging bias, developing bias and transfer bias. Further, the main control board 480 controls a toner replenishing motor 491 based on the output signals from a toner density sensor 490 of the developing unit 13 and turns on and off a fixing heater 493 based on the signals from a thermistor 492.

When an image is formed on a transfer medium using this printer, the image bearing member/image development driving motor 487 is driven based on the signal from PC 483 to rotate the image bearing member 414. With the rotation of the image bearing member 414, the high voltage supplying portion 489 applies a charging bias to the surface of the image bearing member 414 to uniformly charge the charging roller 440. Then, the writing control portion 485 is functioned so that the writing unit 16 irradiates a writing light to perform writing to form a latent electrostatic image on the image bearing member 414. Next, according to the image bearing member/image development driving motor 487, the developing unit 413 is driven simultaneously and a developing roller included in the developing unit 413 is also driven. With that, the high voltage supplying portion 489 applies a developing bias to the image bearing member 414 and attaches toner thereto. As a result, the latent electrostatic image on the image bearing member 414 is visualized with toner.

Next, the image bearing member for use in the image bearing member unit is described in detail.

Figure 12A:
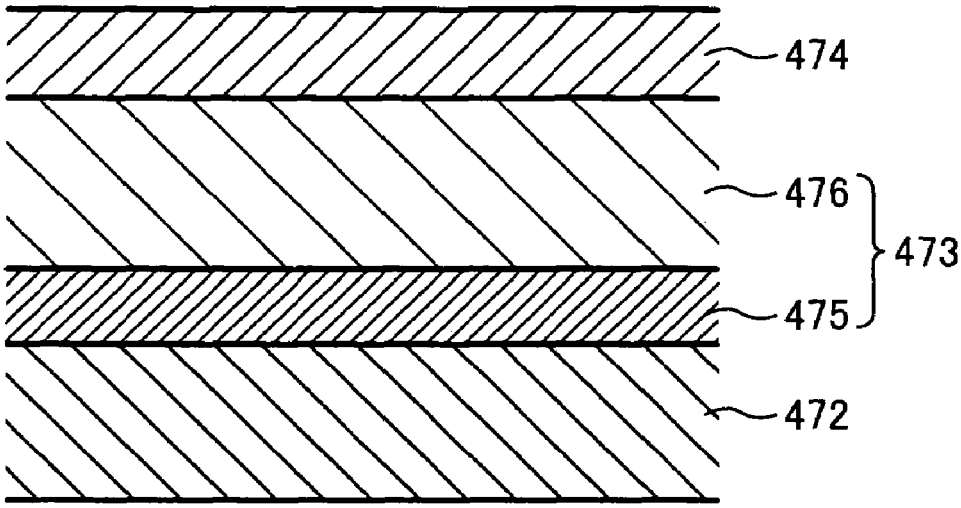
FIGS. 12A and 12B are cross sections illustrating an example of the image bearing member for use in the image forming apparatus of the present invention.
Figure 12B:
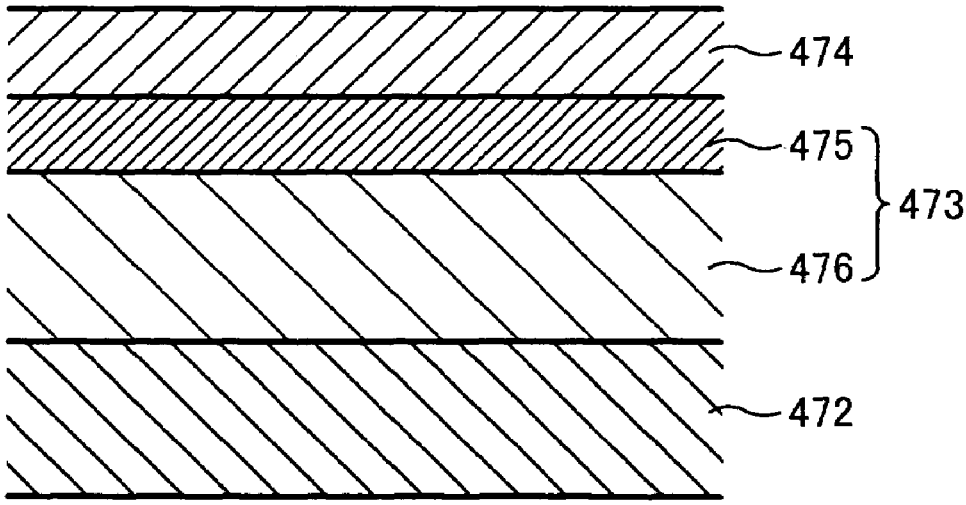

The image bearing member includes, for example, an electroconductive substrate 472 and a photosensitive layer 473 formed thereon as illustrated in FIGS. 12A and 12B. A protective layer 474 is formed on the photosensitive layer 473. The photosensitive layer 473 is formed of a charge generating layer 475 and a charge transport layer 476. As illustrated in FIG. 12A, the charge transport layer 476 can be formed on the charge generating layer 475 and vice versa as illustrated in FIG. 12B.

Next, the image bearing member for use in the present invention is described in detail.

The image bearing member includes an electroconductive substrate and a photosensitive layer formed thereon. A protective layer can be optionally provided on the photosensitive layer. The photosensitive layer is formed of a charge generating layer and a charge transport layer thereon. The order of the two layers can be vice versa. Further, the two layers can be provided in a mixed state.

The diameter of an image bearing member for use in the image forming apparatus of the present invention is preferably from 30 to 100 mm and more preferably from 40 to 80 mm to secure a high linear speed and obtain an area sufficiently to prevent the remaining toner after transfer from interfusing into the lubricant material application area. An excessively small diameter of the image bearing member is not preferred because the remaining toner after transfer can easily interfuse into the lubricant material application area and the surface free energy of the image bearing member tends to vary. An excessively large diameter of the image bearing member is not preferred because the size of the image forming apparatus is large. As described above, a process cartridge integrally having the image formation portions is preferably used because of its easy maintenance and replacement. But an image bearing member having an excessively large diameter is not preferred in this point because such an image bearing member makes the volume and the weight of the process cartridge so large that workability thereof deteriorates.

Materials having a volume resistance of not greater than $10^{10}$ Ωcm can be used as a material for the electroconductive substrate. For example, there can be used plastic or paper having a film or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique and surface-treatment such as cutting, super finishing and grinding is also usable.

The charge generating layer is mainly formed of a charge generating material. Inorganic or organic materials are used as the charge generating material. Specific examples thereof include monoazo pigments, disazo pigments, trisazo pigments, perylene based pigments, perynone based pigments, quinacridone based pigments, quinone based condensed polycyclic compounds, squaric acid dyes, phthalocyanine based pigments, naphthalocyanine based pigments, azulenium salt based dyes, selenium, selenium-tellurium alloys, selenium-arsenic alloys and amorphous silicon. These charge generating materials can be used singly or in combination.

The charge generating layer is formed by coating a liquid dispersion prepared by dispersing a charge generating material and a suitable binder resin in a solvent such as tetrahydrofuran, cyclohexanone, dioxane, 2-butanon and dichloroethane with a ball mill, an attritor, a sand mill or the like. The coating method is a dip coating method, a bead coating method, etc.

Specific examples of the binder resins include polyamide resins, polyurethane resins, epoxy resins, polyketone resins, polycarbonate resins, silicone resins, acryl resins, polyvinyl butyral resins, polyvinyl formal resins, polyvinyl ketone resins, polystyrene resins and polyacryl resins. A suitable content of the binder resin is from 0 to 2 parts by weight based on 1 part by weight of a charge generating material.

The charge generating layer can be formed by a known vacuum thin layer manufacturing method. The thickness of the charge generating layer is from 0.01 to 5 μm and preferably from 0.1 to 2 μm.

The charge transport layer is formed by coating and drying a solvent or a liquid dispersion prepared by dissolving or dispersing a charge transport material and a binder resin in a suitable solvent. Additives such as a plasticizer and a leveling agent can be optionally added.

Specific examples of the charge transport materials include electron accepting materials such as chloranil, bromanil, tetracyanoethylene, tetracyanoquinodimethane, 2,4,7-trinitro-9-fluorenone, 2,4,5,7-tetranitro-9-fluprenone, 2,4,5,7-tetranitroxanthone, 2,4,8-trinitrothioxanthone, 2,6,8-trinitro-4H-indeno[1,2,b]thiphene-4on, 1,3,7-trinitrodibenzothiophene-5,5-dioxide. These charge transport materials can be used singly or in combination.

Specific examples of positive hole carrier materials include electron donating materials such as oxazol derivatives, oxadiazol derivatives, imidazol derivatives, triphenyl amine derivatives, 9-(p-diethylamino styryl anthracene, styryl pyrazoline, phenylhydrazones, α-phenyl stilbene derivatives, thiazol derivatives, triazol derivatives, phenadine derivatives, acridine derivatives, benzofuran derivatives, benzimidazol derivatives and thiophen derivatives. These positive hole carrier materials can be used singly or in combination.

When a charge transport polymer is used as the charge transport material, a charge transport layer can be formed by dissolving or dispersing the polymer in a suitable solvent and applying and drying the resultant. The charge transport polymers include the low-molecular weight charge transport material mentioned above containing a charge transport substitutional group in its main or side chain. The charge transport polymers can optionally contain a binder resin, a low molecular charge transport material, a plasticizer, a leveling agent and a lubricant material in a suitable amount.

Specific examples of the binder resins for use in the charge transport layer together with the charge transport material include thermoplastic resins and thermosetting resins such as polyethylene resins, styrene-acrylonitrile copolymers, styrene-butadiene copolymers, styrene-maleic acid anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, acryl resins, silicon resins, epoxy resins, melamine resins, urethane resins, phenol resins, and alkyd resins.

Specific examples of the solvents include tetrahydrofuran, dioxane, toluene, 2-butanon, monochlorobenzene, dichloroethane and methylene chloride.

The layer thickness of the charge transport layer can be suitably selected from the range of from 5 to 30 μm to desired characteristics of an image bearing member.

The plasticizer optionally added to the charge transport layer is, for example, a plasticizer such as dibutylphthalate and dioctyl phthalate commonly used for a resin. The suitable content of a plasticizer is from 0 to 30% by weight based on the weight of a binder resin.

Specific examples of the leveling agents optionally contained in the charge transport layer include silicone oils such as dimethyl silicon oil and methylphenyl silicone oil and polymers or oligomers having a perfluoroalkyl group in its side chain. The suitable content thereof is from 0 to about 1% by weight based on the weight of a binder resin.

The content of the charge transport material contained in a photosensitive layer is preferably not less than 40% by weight. An excessively small content thereof is not preferred because a sufficient amount of the light decay time in a high speed electrophotography is not secured by the pulse light irradiation of laser beam writing on an image bearing member.

The transport speed of charges on an image bearing member is preferably not less than $3\times10^{-5}$ $cm^2/Vs$ and more preferably $7\times10^{-5}$ $cm^2/Vs$ in the range of the electric field strength of from 2.5 to 5.5 $\times10^5$ V/cm. The structure can be adjusted to achieve this transport speed under each condition. The transport speed can be obtained by a typical method such as TOF method.

It is possible to form an undercoating layer between the electroconductive substrate and the photosensitive layer. A typical undercoating layer is mainly formed of a resin. Such a resin preferably has a high insolubility in a commonly-used organic solvent considering that a photosensitive layer is coated with a solvent on the undercoating layer.

Specific examples of the resins include water-soluble resins such as polyvinyl alcohol resins, casein, sodium polyacrylates, alcohol-soluble resins such as copolymer nylons and methoxymethylated nylon, and curing resins such as polyurethane resins, melamine resins, alkyd-melamine resins and epoxy resins which form three-dimensional mesh structure.

The undercoating layer can optionally contain fine powder of metal oxides such as titaniumoxides, silica, alumina, zirconiumoxides, tin oxides and indium oxides to prevent the occurrence of moiré and reduce the residual voltage.

This undercoating layer can be formed using a suitable solvent and method as in the case of forming the photosensitive layer mentioned above. Further, as an undercoating layer, it is effective to use a metal oxide layer formed by, for example, a sol-gel method, using a silane-coupling agent, a titan coupling agent and a chrome coupling agent.

Further, it is also effective to form an undercoating layer using anodic oxidation, or by a vacuum thin layer method using an organic compound such as polyparaxylylene (parylene) or an inorganic compound such as SiO, $SnO_2$, $TiO_2$, ITO, and $CeO_2$. The layer thickness of the undercoating layer is suitably from 0 to 5 μm.

A protective layer containing a filler is formed on the photosensitive layer as an uppermost surface layer to protect the photosensitive layer and improve the durability thereof.

Specific examples of the materials for use in this protective layer include resins such as ABS resins, ACS resins, olefin-vinylmonomer copolymers, chlorinated polyether resins, allyl resins, phenol resins, polyacetal resins, polyamide resins, polyamidimide resins, polyacrylate resins, polyallylsulfonic acid resins, polybutylene resins, polybutylene terephthalate resins, polyimide resins, acryl resins, polymethyl pentene resins, polypropylene resins, polyphenyl oxido resins, polysulfone resins, AS resins, AB resins, BS resins, polyurethane resins, polyvinyl chloride resins, polyvinylidene chloride resins and epoxy resins. A filler is added to the protective layer to improve the anti-abrasion property thereof.

Specific examples of the filler include fluorine containing resins such as polytetrafluoroethylene resins, silicone resins, and these resins in which organic materials such as titanium oxide, tin oxide and potassium titanic acid are dispersed.

The content of the filler contained in the protective layer is from 10 to 40% and preferably from 20 to 30% by weight. When the content of a filler is too small, the abrasion tends to be heavy and thus the durability deteriorates. When the content of a filler is too large, the rise of the voltage for the portion lighted during irradiation increases and resultantly the deterioration of the sensitivity is not ignorable, which is not preferred.

Further, a protective layer can optionally contain a dispersion helper to improve the dispersability of a filler. A dispersion helper for use as a coating material can be suitably used. The content thereof is from 0.5 to 4% and preferably from 1 to 2% by weight based on the weight of a filler.

It is also effective for a protective layer to contain the charge transport material mentioned above and an anti-oxidant. This antioxidant is described later.

Typically used coating methods such as a spraying method are adopted as can be adopted. The layer thickness of a protective layer is from 0.5 to 10 μm, and preferably from 4 to 6 μm.

It is significant to make the existence form of the filler in a protective layer constant for anti-abrasion property and image characteristics. That is, according to the existence of the protective layer, finability and high speed responsibility can be improved without degrading the sensitivity and the electrostatic stability of the photosensitive layer and the finability of irradiation when the layer thickness is thinned due to the anti-abrasion property.

To satisfy this demand, the content of the filler is desired to be from 3 to 5% by area for the cross section anywhere in a protective layer. In addition, the filler contained in a protective layer has a peak between 0.2 to 0.3 μm in the particle size distribution including the secondary particle. Further, the area occupied by the filler having a particle size of not less than 0.3 μm is from 10 to 30% based on all the filler occupying area for the cross section anywhere in a protective layer. When the values are too small or too large, it is confirmed by the present inventors that the residual voltage tends to rise, the sensitivity tends to deteriorate, the definition tends to decrease, anti-abrasion property tends to deteriorate and abnormal images ascribable to filming tends to occur.

The existence form of a filler in a protective layer can be controlled by the particle size and the distribution of a filler material, the recipe of liquid for application and the application device. Therefore, it is effective to use a dispersion helper.

It is possible to form another undercoating layer between the photosensitive layer and the protective layer. The intermediate layer typically contains a binder resin as a main component. Specific examples of the binder resins include polyamide resins, alcohol-soluble nylon, water-soluble polyvinyl butyral resins, and polyvinyl alcohol resins. As a method of forming the intermediate layer, the typical coating methods mentioned above can be adopted. The layer thickness of the intermediate layer is suitably from about 0.05 to 2 μm.

In addition, to improve the anti-environment property, especially to prevent deterioration of the sensitivity and the rise of the residual voltage, an anti-oxidant, a plasticizer, a lubricant, an ultraviolet ray absorbent, a low molecular weight charge transport material and a leveling agent can be contained in each layer.

Specific examples of additives which can be contained in each layer include phenol based compounds such as 2,6-di-t-butyl-p-cresol, butylated hydroxyanisole, 2,6,di-t-butyl-4-ethylphenol, n-octadecyl-3-(4-hydroxy-3,5,-di-t-butylphenol), 2,2-methylene-bis-(4-ethyle-6-t-butylphenol), 4,4-thiobis-(3-methyl-6-t-butylphenol), 4,4-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)bnzene, tetrakis-[methylene-3-(3,5-di-t-butyl-4-hydroxyphenyl)propionate]methane, bis[3,3-bis(4-hydroxy-3-t-butylphenyl)butylic acid]glycol ester and tocopherol, paraphenylene diamines such as N-phenyl-N-isopropyl-p-phenylenediamine, N,N-di-sec-butyl-p-phenylene diamine, N-phenyl-N-sec-butyl-p-phenylene diamine, N,N-dimethyl-N,N-di-t-butyl-p-phenylene diamine, and N,N-dimethyl-N,N-di-t-butyl-p-phenylene diamine, hydroquinones such as 2,5-di-t-octylhydroquinone, 2,6-didodecyl hydroquinone, 2-dodecyl hydroquinone, 2-dodecyl-5-chlorohydroquinone, 2-t-octyl-5-methyl hydroquinone, and 2-(2-octadecenyl)-5-methyl hydroquinone, organic sulfur compounds such as dilauryl-3,3-thiodipropionate, distearyl-3.-,3-thiodiopropionate, and ditetradecyl-3,3-thiodipropionate and organic phosphoric compounds such as triphenyl phosphine, tri(nonylphenyl)phosphine, tri(dinonyl phenyl)phosphine, tricrezyl phosphine, and tri(2,4-dibutylphenoxy)phosphine.

Specific examples of the plasticizers which can be contained in each layer include ester plasticizers of phosphoric acid triphenol phosphate, tricrezyl phosphate, trioctyl phosphate, octyl diphenyl phosphate, trichloroethyl phosphate, crezyl phenyl phosphate, tributyl phosphate, tri-2-ethylhexyl phosphate and triphenyl phosphate, ester plasticizers of phosphoric acid such as dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl, octyldecyl phthalate, dibutyl phthalate and dioctyl phthalate and ester plasticizers of aromatic carboxylic acid, trioctyl trimellitic acid, tri-n-octyl trimellitic acid and octyl oxybeozoate, ester plasticizers of aliphatic diacids such as dibutyl adipic acid, di-n-hexyl adipic acid, di-2-ethylhexyl adipic acid, di-n-octyl adipic acid, n-octyl-n-decyl adipic acid, diisodecyl adipic acid, dicapryl adipic acid, di-2-ethyl hexyl azelaic acid, dimethyl sebacate, diethyl sebacate, dibutyl sebacate, di-n-octyl sebacate, di-2-ethyl hexyl sebacate, di-2-ethoxyethyl sebacate, dioctyl succinate, diisodecyl succinate, dioctyl tetrahydrophthlate, di-n-octyl tetrahydrophthalate, aliphatic acid ester derivative based plasticizers such as butyl oleate, esters of glycelin monooleic acids, methyl acetyl ricinoleate, pentaerythritol esters, dipenta erythritol hexaesters, triacetin and tributyline, esters of oxoic acid such as acetyl methyl licinoleate, acetyl butyl licinoleate, butyl phthalyl butyl glycolate and tributyl acetyl citrate, epoxydized soybean oil, epoxydized linseed oil, epoxy butyl stearate, epoxy decyl stearate, epoxy octyl stearate, epoxy benzyl stearate, epoxy dioctyl hexahydrophtalate and epoxy didecyl hexahydrophthalate, dialcohol ester plasticizers such as diethyleneglycoldibenzoate and triethylene glycol di-2-ethyl butyrate, chorine containing plasticizers such as chlorinated paraffin, chlorinated diphenyl, chlorinated methyl fatty acid and methoxy chlorinated methyl fatty acid, polyester plasticizers such as polypropylene adipate, polypropylene cebacate, polyesters and acetylated polyesters, sulfonate derivative plasticizers such as p-toluene sulfonamides, o-tolene sulfonamides, p-toluene sulfon ethylamide, o-toluene sulfon ethylamides, toluene sulfone-N-ethylamides and p-toluene sulfon-N-cyclohexyl amides, citric acid derivative plasticizers such as triethyl citric acid, triethyl acetyl citric acid, tributyl citric acid, tributyl acetyl citric acid, tri-2-ethylhexyl acetyl citric acid and n-octyldecyl acetyl citric acid, terphenyl, partially hydrogenerated terphenyl, camphor, 2-nitrodiphenyl, dinonyl naphthaline, and methyl abietic acid.

In addition, specific examples of the lubricants which can be contained in each layer include hydrocarbon compounds such as liquid paraffin, paraffin wax, microwax and lower polyethylenes, fatty acid compounds such as lauric acid, myristic acid, palmitic acid, stearic acid, arachic acid and behenic acid, fatty acid amides such as stearyl amides, palmityl amides, olein amides, methylene bis stearoamides and ethylene bis stearoamides, esters such as lower alcohol esters of fatty acids, polyalcohols of fatty acids and polyglycol esters of fatty acids, alcohol compounds such as cetyl alcohol, stearyl alcohol, ethylene glycol, polyethylene glycol and polyglycerol, metal soaps of lead stearate, cadmium stearate, barium stearate, calcium stearate, zinc stearate and magenesium stearate, natural wax such as carnauba wax, candelila wax, bees wax, whale wax, insect wax and montan wax, silicon compounds and fluorine compounds.

Specific examples of ultraviolet ray absorbents which can be contained in each layer include benzophenon based ultraviolet absorbents such as 2-hydroxybenzophenon, 2,4-dihydroxybenzophenon, 2,2,4-trihydroxybenzophenon, 2,2,4,4-tetrahydroxy benzophenon and 2,2-dihydroxy-4-methoxy benzophenon, salicylates based ultraviolet ray absorbents such as phenyl salicylate, and 2,4-di-t-butyl phenyl 3,5-di-t-butyl-4-hydroxy benzoate, benzotriazol based ultraviolet ray absorbents such as (2-hydroxy-5-methylphenyl)benzotriazol, (2-hydroxy-5-methylphenyl)benzotriazol, (2-hydroxy-5-methyhlphenyl)benzotriazol, and (2-hydroxy-3-tertiary butyl-5-methylphenyl)5-chloro benzotriazol, cyanoacrylate based ultraviolet rayabsorbents such as ethyl-2-cyano-3,3-diphenylacrylate and methyl-2-carbomethoxy-3-(paramethoxy)acrylate, quencher (metal complex) ultraviolet ray absorbents such as nickel (2,2-thiobis(4-t-octyl)phenolate) normal butylamine, nickel dibutyldithiocarbamate, and cobalt dicyclohexyl dithiophosphate, hidered amine (HALS) based ultraviolet ray absorbents such as bis(2,2,6,6-tetramethyl-4-piperidyl)cebacate, bis(1,2,2,6,6-pentamethyl-4-piperidyl)cebacate, 1-{2-[3-(3,5-di-t-butyl-4-hydroxyphenyl) propionyloxy]ethyl}-4-[3-(3,5-di-t-butyl-4-hydroxyphenyl) prpropionyloxy]-2,2,6,6-tetrameth yl pyridine, 8-benzyl-7,7,9,9-tetramethyl-3-octyl-1,3,8-triazaspiro[4,5]undeca ne-2,4-dion and 4-benzoyloxy-2,2,6,6-tetramethylpiperidine.

The image bearing member is formed by forming a photosensitive layer and a protective layer and optionally an undercoating layer and an intermediate layer on an electroconductive substrate. The protective layer contains a filler to improve anti-abrasion property to obtain excellent durability. Further, as described above, the image bearing member has excellent durability and stability against high speed electrophotographic process by stabilizing the existence form of a filler in the protective layer. Furthermore, when zinc stearate is provided on the protective layer, it is possible to restrain the occurrence of filming while the anti-abrasion property is kept in good state. Furthermore, in electrophotographic process using the image bearing member, the occurrence of image flow can be restrained while keeping anti-abrasion property by repeating toner attachment on the image bearing member and the toner retrieval at the cleaning portion not in image formation.

The image bearing members illustrated in figures have a drum form but can also have a belt form having a high surface hardness.

In one embodiment of the present invention, for example, a lubricant material (e.g., zinc stearate) having 0.01 to 0.5% by weight is added to a toner. Thereby, the lubricant material can be coated on the surface of the image bearing member.

Toner contains a binder resin, a coloring agent and a charge controlling agent as main components with optional other additives. Specific examples of the binder resins include styrene based resins (monopolymers or copolymers containing styrene or styrene substituent) such as polystyrene, chloropolystyrene, poly-α-methylstyrene, copolymers of styrene and chlorostyrene, copolymers of styrene propylene, copolymers of styrene and butadiene, copolymers of styrene and vinylchloride, copolymers of styrene and vinyl acetate, copolymers of styrene and maleic acid, copolymers of styrene and acrylate (e.g., copolymers of styrene and methyl acrylate, copolymers of styrene and ethyl acrylate, copolymers of styrene and butyl acrylate and copolymers of styrene and phenyl acrylate), copolymers of styrene and methacrylate (e.g., copolymers of styrene and methyl methacrylate, copolymers of styrene and ethyl methacrylate, copolymers of styrene and butyl methacrylate and copolymers of styrene and phenyl methacrylate), copolymers of styrene and α-methyl chloroacrylate, and copolymers of styrene, acrylonitrile and acrylate, vinyl chloride resins, rosin modified maleic acid resins, phenyl resins, epoxy resins, polyester resins, low molecular weight polyethylenes, low molecular weight polypropylenes, ionomer resins, polyurethane resins, ketone resins, copolymers of ethylene and ethylacrylate, xylene resins, and polyvinyl butyral.

Any known coloring agents (for example, yellow, magenta, cyan and black) for use in a toner can be used. The content of such a coloring agent is suitably from 0.1 to 15 parts by weight and preferably from 0.15 to 9 parts by weight based on 100 parts by weight of a binder resin.

Specific examples of the charge controlling agents include nigrosine dyes, compounds containing a chrome complex and quaternary ammonium salts. These are suitably selected depending on the polarity of toner particles. The content of the charge controlling agent is from 0.1 to 10 parts by weight and preferably from 0.2 to 7 parts by weight based on 100 parts of a binder resin.

Further, it is suitable to add a fluidizing agent to the obtained toner particles. Specific examples of such fluidizing agents include fine particles of metal oxides such as silica, alumina, magnesia, zirconia, ferrite, and magnetite and these fine particles the surface of which is treated or coated by treating agents such as silane coupling agents, titanate coupling agents, zircoaluminate, quaternary ammonium salts, fatty acids, metal salts of fatty acids, fluorine containing active agents, solvents and polymers, fine particles of fatty acids such as stearic acid and metal salts such as zinc stearate and those which are surface treated by the treating agents mentioned above, and polymer particulates of, for example, polystyrene, methyl polymethacrylate and polyvinylidene fluoride and those which are surface treated or coated by the treating agents mentioned above. The particle diameter of these fluidizing agents is from 0.01 to 3 μm.

The addition amount of these fluidizing agents is from 0.1 to 7.0 parts by weight and preferably from 0.2 to 5.0 parts by weight based on 100 parts by weight of toner particles. A toner and a fluidizing agent and a lubricant material are mixed by moving powder thereof in flowing state at a high speed with air flow, mechanical power, etc., without substantially pulverizing the powder. Specific examples of mixing machines include a mixer for high speed flowing type such as HENSCHEL mixers and UM mixers. A fluidizing agent and a lubricant material can be separately added to toner particles in several times. However, the lubricant material is desired to be efficiently transferred to an image bearing member. Therefore, it is preferred to externally add a lubricant material singly or together with a fluidizing agent.

Toner for use in a two component developer can be manufactured by various kinds of known methods or any combination thereof. For example, in mixing, kneading and pulverizing methods, a binder resin, coloring agents such as carbon black and desired additives are mixed and dried, and the mixture is heated, melted and kneaded with an extruder, two rollers, three rollers, etc. Subsequent to cooling down and solidification, the resultant is pulverized by a pulverizer such as a jet mill, and classified by an air classifier to obtain a toner. It is also possible to directly manufacture a toner using a monomer, coloring agents and additives by a suspension polymerization method or a non-aqueous dispersion polymerization method.

Typically, those carrier core materials themselves are used or those having a covering layer on the carrier material are used. Specific examples of resin coated carrier core materials which can be used in the present invention include ferrite and magnetite. The particle size of the core material is from 20 to 65 μm and preferably from about 30 to about 60 μm.

Monomers containing fluorine for use in forming carrier coating layer are, for example, vinylidene fluoride, tetrafluoroethylene, hexafluoropropylene, perfluoroalkyl vinyl ether, vinyl ether formed by substituting fluorine atoms, and vinyl ketone formed by substituting fluorine atoms. The polymers thereof are copolymers of vinylidene fluoride and tetrafluoroethylene, copolymers of vinylidene fluoride and hexafluoropropylene, copolymers of perfluoroalkyl vinyl ether, vinylidene fluoride and tetrafluoroethylene, vinylidene fluoride polymers, copolymers of tetrafluoroethylene, polymers containing vinyl ether formed by substituting fluorine atoms, polymers containing vinylketone formed by substituting fluorine atoms, fluorinated alkyl acrylate polymers and fluorinated alkyl methacrylate polymers.

Specific examples of components which copolymerize with the fluorine containing monomers mentioned above include styrene, methyl styrene, dimethyl styrene, trimethyl styrene, acrylic acid, methacrylic acid, methyl acrylate, butyl methacrylate, butyl methacrylate, benzyl acrylate, benzyl acrylate, benzyl methacrylate, amide acrylate, amide methacrylate, cyclohexyl acrylate, cyclohexyl methacrylate, hydroxyethyl acrylate, glycidyl acrylate, glycidyl methacrylate, vinyl acetate, ethylene and propylene. The method of forming a coated layer is the same as typical in which resins are coated on the surface of carrier core particles by a spraying method, a dip coating method, etc.

In the illustrated embodiments, the present invention is described using a color printer but can be applied to other image forming apparatuses such as a photocopier, a facsimile machine and also to a two-color or monochrome image forming apparatus.

Figure 14:
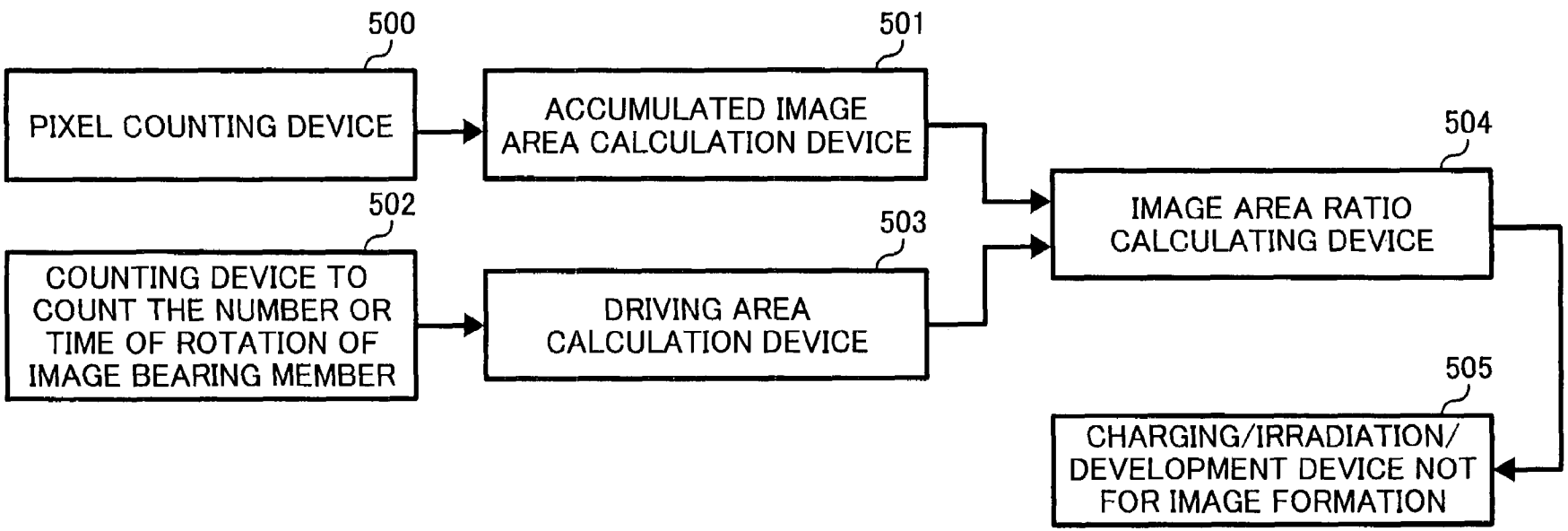
FIG. 14 is a block diagram illustrating an example of the control of the charging/irradiation/development having a purpose other than image formation.

FIG. 14 is a control block chart illustrating a charging/irradiation/development not for image formation (or having a purpose other than image formation).

In FIG. 14, numeral 500 represents a pixel counting device to count the number of writing pixels and numeral 501 represents an image area calculation device to calculate the accumulated image area based on the output from the pixel counting device 500.

The image area of an image formed on an image bearing member developed by a developing unit can be obtained from the following relationship:

[Image area]=[Number of pixels counted]×[Area of one pixel].

Since the area of one pixel is already determined, the image area can be obtained by counting the number of writing pixels using the pixel counting device 500.

Having a purpose other than image formation, a charging/irradiation/development device 505 not for image formation functions based on the calculation result of the accumulated image area calculation device 501 and a developer is attached to the image bearing member to supply a lubricant thereto by the developing unit, which has a purpose other than development.

In FIG. 14, numeral 502 represents a counting device to count the number or time of rotation of the image bearing member and numeral 503 represents a driving area calculation device to calculate the driving area of the image bearing member based on the output of the counting device 502.

The driving area of the image bearing member can be obtained by the following relationship:

[Driving area]=[Driving distance]×[Width of image formation].

The driving distance can be obtained by the following relationship:

[Driving distance]=[Number of rotation of image bearing member]×[Circumference of image bearing member]

Since the circumference of the image bearing member is already determined, the driving distance can be obtained by counting the number of rotation of the image bearing member by the counting device 502. It is also possible to calculate the driving distance by counting the rotation time of the image bearing member based on the linear speed thereof.

The outputs of the image area calculating device 501 and the driving area calculating device 503 are input to an image area ratio calculating device 504 to calculate the ratio of the image area to the driving area of the image bearing member using the following relationship:

[Image area ratio]=[Image area]/[Driving area]

Based on the calculated image area ratio, the charging irradiation development device 505 is set in motion and attaches a developer to the image bearing member to supply a lubricant material thereto (not for image formation).

In the image forming apparatus of the present invention, there is provided an image information calculation device to calculate image information area by area each of which is formed by dividing the surface of an image bearing member in the direction perpendicular to the rotation direction of the image bearing member. The image information calculation device for calculating the image information of the surface of the image bearing member calculates the image area for each divided area as described above. In addition, the image information calculation device also calculates the image area ratio for each divided area from the driving distance of the image bearing member, etc.

Figure 15:
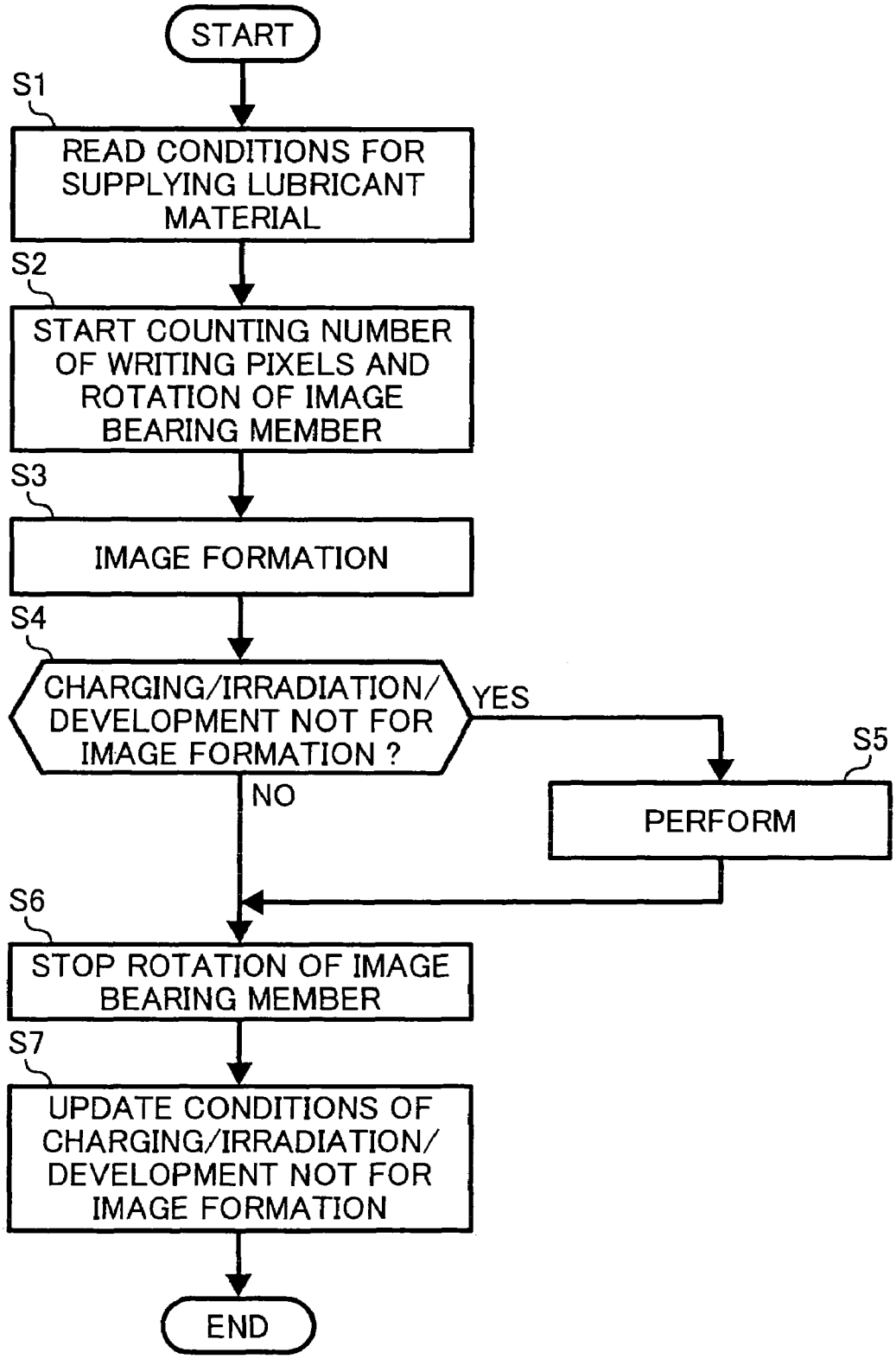
FIG. 15 is a flow chart illustrating an example of the charging/irradiation/development having a purpose other than image formation.

FIG. 15 is a flow chart illustrating an example of the charging/irradiation/development device having a purpose other than image formation.

When the controller board 482 receives image data from the PC 483 connected thereto via network, etc., the central processing unit (CPU) in the main control board 480 reads the charging/irradiation/development conditions (whether to perform charging/irradiation/development and the irradiation pattern when performed) having a purpose other than image formation stored in a non-volatile random access memory (NVRAM) in Step S1. In Step S2, the pixel counting device 500 starts counting the number of pixels P1 to Pn (n is an integer greater than 1) for areas divided into N (=n) in the direction perpendicular to the transfer direction of the image bearing member. The counting device 502 starts counting the number or time of the rotation of the image bearing member.

In Step S3, a toner image is formed on the image bearing member while the image bearing member rotates repeating charging, writing, developing, transferring, cleaning, discharging, etc. The toner image is transferred to a transfer medium.

After last image formation on a transfer medium of one job (from when the rotation of the image bearing member starts to when the rotation thereof stops) is complete, it is determined whether to perform charging/irradiation/development having a purpose other than image formation in Step S4. When it is determined to perform the charging/irradiation/development, the charging/irradiation/development device 505 performs the charging, irradiation and development in Step S5. The rotation of the image bearing member is stopped in Step S6. That is, when charging, irradiation and development are performed not for image formation, the charging/irradiation/development 105 not for image formation attaches a developer to the image bearing member by the developing unit to supply a lubricant material to the image bearing member after the development operation corresponding to the last latent image of one job is finished. When it is determined not to perform the charging/irradiation/development, Step S5 is skipped and the rotation of the image bearing member is stopped in Step S6.

In Step S7, the charging/irradiation/development condition is memorized in NVRAM for update and the values on the counter in the pixel counting device 500 and the counting device 502 are cleared.

Figure 16:
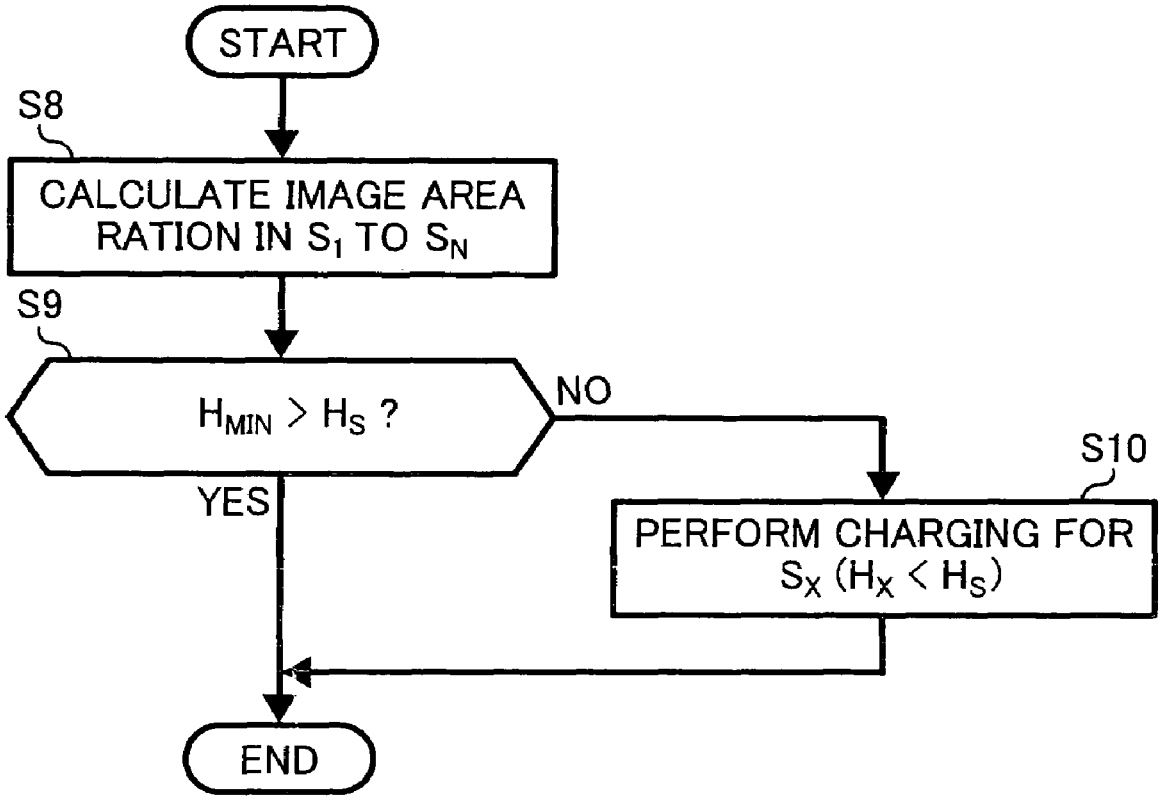
FIG. 16 is a flow chart illustrating another example of the charging/irradiation/development having a purpose other than image formation.

FIG. 16 is a flow chart illustrating an example of determination in Step S7 of the condition of charging/irradiation/development having a purpose other than image formation. First, the image area ratios H1 to Hn (n is an integer greater than 1) for corresponding areas S1 to Sn (which are formed by dividing the surface of the image bearing member into N (=n)) in the direction perpendicular to the transfer direction of the image bearing member (Step S8). Next, it is confirmed whether the Hmin, which is the minimum among H1 to Hn, is greater than Hs, which is the criteria of the image area ratio (Step S9). When Hmin is not greater than Hs, it is determined to perform charging/irradiation/development having a purpose other than image formation for an area Sx (x is an integer of from 1 to n) in which Hx is less than Hs (Step S10).

After the next job, charging/irradiation development having a purpose other than image formation is performed based on the updated condition of the charging/irradiation/development having a purpose other than image formation. As described above, based on the counting results of the prior job, the conditions of charging/irradiation/development having a purpose other than image formation are determined. Therefore, it is possible to control the determination of the condition of charging/irradiation/development having a purpose other than image formation by counting the number of rotations and pixels of the image bearing member during one job in real time. Consequently, the program can be simplified and the burden on the CPU can be greatly reduced.

The lubricant material transferred from a toner to the image bearing member is extended by the cleaning blade of a cleaning device so that the lubricant material is uniformly applied to the surface of the image bearing member. Therefore, in an image forming apparatus using a contact type transfer device as the transfer device, it is preferred to prevent a toner from attaching to the transfer device by detaching the transfer device or applying a reversed bias during performing charging/irradiation/development having a purpose other than image formation to heighten the supplying efficiency of a lubricant material.

When the image area ratio is based on the size of a transfer medium, the consumed amount of a toner can be different for the same image area ratio depending on the size. However, as described above, the image area ratio is calculated based on the driving area of the image bearing member. Therefore, it is possible to predict the impact on the abrasion of the image bearing member by detecting the consumed amount of a toner exactly in various cases. For example, in the cases of when images are formed on various sizes of transfer media or when images are formed one by one or continuously formed in a massive amount.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An image bearing member is manufactured by applying liquids of application for an undercoating layer, a charge generating layer, a charge transport layer and a protective layer in this order to an aluminum substrate having a diameter of 60 mm.

The liquid of application for the undercoating layer is prepared as follows: Dissolve 15 parts of alkyd resin (BEKKOLITE M6401-50, manufactured by Dainippon Ink and Chemicals, Incorporated) and 10 parts of melamine resin (Super Bekkamin G-821-60, manufactured by Dainippon Ink and Chemicals, Incorporated) in 150 parts of methylethyl ketone; Add 90 parts of titanium oxide powder (Tipaque CR-EL, manufactured by Ishihara Sangyo Kaisha, Ltd.) to the resultant; and disperse the resultant with a ball mill for 12 hours.

The liquid of application for the undercoating layer is applied to the aluminum substrate by a dip coating method and dried at 130° C. for 20 minutes to obtain the undercoating layer having a thickness of 3.5 μm.

The liquid of application for the charge generating layer is prepared as follows: Dissolve 4 parts of polyvinyl butyral (XYHL, manufactured by UCC Co., Ltd.) in 150 parts of cyclohexanone; Add the bisazo pigment represented by the following chemical structure (A) in the solution; Disperse the resultant with a ball mill for 48 hours; Further add 210 parts of cyclohexanone thereto and disperse the resultant for another 3 hours; and place and dilute the liquid dispersion in a container with cyclohexanone such that the solid portion thereof is 1.5% by weight.

The thus obtained liquid of application for the charge generating layer is applied to the undercoating layer and dried at 130° C. for 20 minutes to form the charge generating layer having a thickness of 0.15 μm The surface free energy of this image bearing member is measured according to a preferred surface free energy measuring method for use in the present invention. The contact angles of diiodo methane, α-bromonaphthalene, glycerine, diethylene glycol are measured at 14 points having an interval of 20 mm which start from 45 mm from the end of the image bearing member in the direction perpendicular to the rotation direction of the image bearing member.

[Chemical structure A]

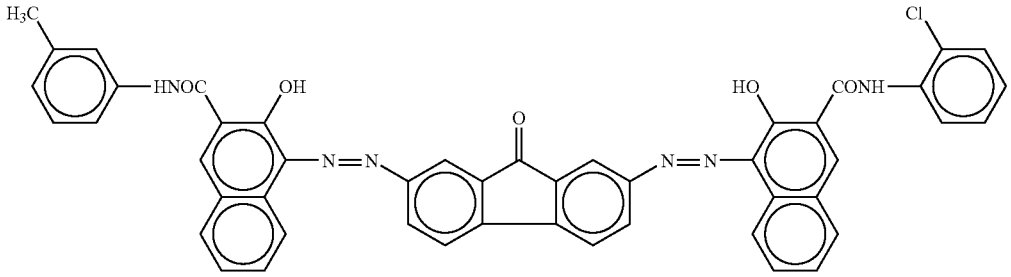

The liquid of application for the charge transport layer is prepared as follows: Dissolve 10 parts of bisphenol Z type polycarbonate resin and 0.002 parts of silicone oil (KF-50, manufactured by Shin-Etsu Chemical Co., Ltd.) in 100 parts of tetrahydrofuran; And add 10 parts of the charge transport material represented by the following chemical structure (B) to the solution.

The thus obtained liquid of application for the charge generating layer is applied to the charge generating layer by a dip coating method and dried at 110° C. for 20 minutes to obtain the charge transport layer having a thickness of 22 μm.

[Chemical Structure (B)]

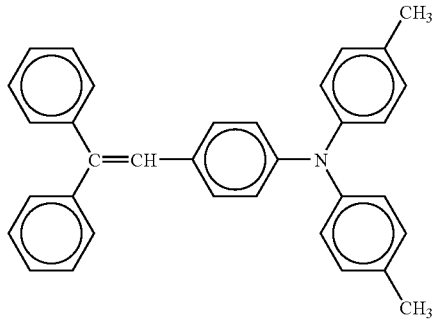

The liquid of application for the protective layer is prepared as follows: Dissolve 4 parts of bisphenol Z type polycarbonate resin in a mixed solvent containing 280 parts of tetrahydrofuran and 80 parts of cyclohexanone; And add 3 parts of the charge transport material represented by the chemical structure (B) and a liquid dispersion in which 2.3 parts of α-alumina is dispersed in 38.5 parts of cyclohexanone to the solution.

The thus obtained liquid of application for the protective layer is applied to the charge transport layer by a spray coating method with an air pressure of 2 kgf/cm$^2$ using a spraying gun (Piece Com PC308, manufactured by Olympos Co., Ltd.). After spraying three times, the liquid of application is dried at 135° C. for 20 minutes to obtain the protective layer having a thickness of 4.5 μm.

When the contact angles of diiodo methane, α-bromonaphthalene, glycerine, diethylene glycol are measured, the image bearing member is rotated so that the point measured for one of the solvents is not used for the other solvent while the distance between the point and the end of the image bearing member is kept the same. The surface free energy of the image bearing member based on the results of the measuring the contact angles of each solvent is from 50.2 to 50.7 mN/m. The difference between the maximum and the minimum of the surface free energy of the 14 points is from 0.0 to 0.2 mN/m.

The image bearing member is assembled onto a tandem type color image forming apparatus (imagio Neo C600, manufactured by Ricoh Co., Ltd.), which has a mechanism of coating zinc stearate on the image bearing member. Images are formed using a toner having an average particle diameter of 6.4 μm to which zinc stearate having 0.16% by weight is externally added. One job is that 5 sheets of two kinds of charts having an average image area of 6% in which characters are uniformly arranged are continuously printed. The total number of printed images is 70,000.

After the image formation test, the surface free energy of each image bearing member for black, yellow, cyan and magenta is measured. The average surface free energy of each image bearing member for black, yellow, cyan and magenta is 27.0, 26.4, 27.5 and 27.9 mN/m, respectively. The difference between the maximum and the minimum of the surface free energy of each image bearing member for black, yellow, cyan and magenta is 1.2, 1.6, 2.3 and 1.4 mN/m, respectively. Halftone images, solid images, lattice images for each color and landscape images photographed by a digital still camera are formed. The obtained images are all of high quality.

Example 2

An image formation test is performed in the same manner as in Example 1 except that the mechanism of coating zinc stearate in the image forming apparatus is placed from the upstream side to the downstream side of the cleaning blade and the chart used has image data on its left half and characters on its right half The average image area is 20% on the left half and 2% on the right half. The average image area of the entire charge is about 10%. The number of images formed is 30,000.

As in Example 1, the surface free energy of each image bearing member for black, yellow, cyan and magenta are measured after the image formation test. The average surface free energy of each image bearing member for black, yellow, cyan and magenta is 26.8, 27.8, 27.2 and 27.5 mN/m, respectively. The difference between the maximum and the minimum of the surface free energy of each image bearing member of black, yellow, cyan and magenta is 3.9, 2.7, 4.2 and 2.1 mN/m, respectively. Halftone images solid images, lattice images for each color and landscape images photographed by a digital still camera are formed. The obtained images are all of high quality.

Comparative Example 1

An image formation test is performed in the same manner as in Example 2 except that the mechanism of coating zinc stearate in the image forming apparatus is placed on the upstream side of the cleaning blade.

As in Example 2, the surface free energy of each image bearing member for black, yellow, cyan and magenta are measured after the image formation test.

The average surface free energy of each image bearing member for black, yellow, cyan and magenta is 31.2, 28.8, 29.4 and 32.3 mN/m, respectively. The difference between the maximum and the minimum of the surface free energy of each image bearing member of black, yellow, cyan and magenta is 7.5, 4.1, 8.7 and 5.9 mN/m, respectively. Halftone images for each color are formed. The obtained black, cyan and magenta images have non-uniform density with streak patterns.

Example 3

An image formation test is performed in the same manner as in Example 2 except that the toner used is a toner having an average particle diameter of 5.8 μm to which zinc stearate having 0.15% by weight is externally added.

As in Example 2, the surface free energy of each image bearing member for black, yellow, cyan and magenta are measured after the image formation test. The average surface free energy of each image bearing member for black, yellow, cyan and magenta is 27.0, 27.5, 27.4 and 27.5 mN/m, respectively. The difference between the maximum and the minimum of the surface free energy of each image bearing member of black, yellow, cyan and magenta is 4.1, 3.3, 2.9 and 1.8 mN/m, respectively. Halftone images, solid images, lattice images for each color and landscape images photographed by a digital still camera are formed. The obtained images are all of high quality.

Example 4

Figure 17:
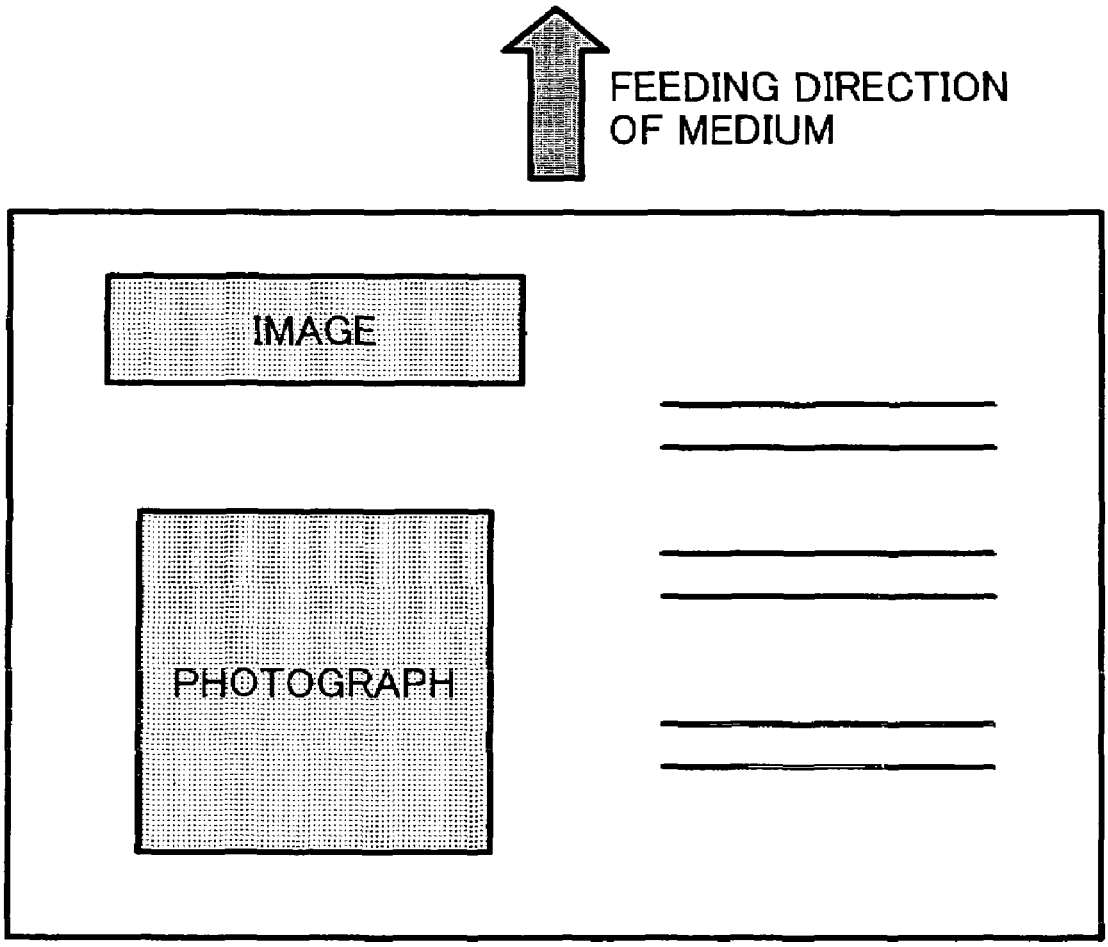
FIG. 17 is a diagram illustrating an example for use in Examples.

An image formation test is performed in the same manner as in Example 3 except that the chart used has image date on its left half and characters on its right half as illustrated in FIG. 17. The average image area is 22% on the left half and 2% on the right half. The average image area of the entire charge is about 10%. The number of images formed is 50,000. The toner uses has an average particle diameter of 5.8 μm and zinc stearate having 0.08% by weight is externally added thereto.

As in Example 3, the surface free energy of each image bearing member for black, yellow, cyan and magenta are measured after the image formation test. The average surface free energy of each image bearing member for black, yellow, cyan and magenta is 27.7, 28.8, 28.3 and 27.4 mN/m, respectively. The difference between the maximum and the minimum of the surface free energy of each image bearing member of black, yellow, cyan and magenta is 2.9, 3.5, 3.3 and 4.0 mN/m, respectively. Halftone images, solid images, lattice images for each color and landscape images photographed by a digital still camera are formed. The obtained images are all of high quality.

Comparative Example 2

An image formation test is performed in the same manner as in Example 4 except that the mechanism of coating zinc stearate in the image forming apparatus is placed on the upstream side of the cleaning blade and the number of images formed is 10,000.

As in Example 4, the surface free energy of each image bearing member for black, yellow, cyan and magenta is measured after the image formation test.

The average surface free energy of each image bearing member for black, yellow, cyan and magenta is 34.5, 28.0, 29.3 and 33.5 mN/m, respectively. The difference between the maximum and the minimum of the surface free energy of each image bearing member of black, yellow, cyan and magenta is 12.1, 9.3, 15.2 and 6.1 mN/m, respectively. Halftone images for each color are formed. The obtained black, yellow, cyan and magenta and images have non-uniform density with streak patterns.

Example 5

An image bearing member is manufactured as follows: accumulate an undercoating layer in which titanium oxide is dispersed in alkyd-melanine resin on an aluminum substrate (electroconductive substrate) having a diameter of 30 mm and a length of 340 mm; accumulate a charge generating layer having a bisazo based pigment thereon; coat a charge transport layer containing the following liquid of application for the charge transport layer thereon; coat a protective layer containing the following liquid of application for the protective layer thereon; subsequent to drying, the image bearing member having the undercoating layer having a thickness of 3.5 μm, the charge generating layer having a thickness of 0.15 μm, the charge transport layer having a thickness of 25 μm and the protective layer having a thickness of about 4.5 μm. Forty of the image bearing members are manufactured. The protective layer is coated by a spraying method. The other layers are formed by a dip coating method.

| | |
|---|---|
| Liquid of application for charge transport layer | 10 parts |
| Bisphenol Z type polycarbonate (Zpolyca, viscosity average molecular weight Mv: 50,000, manufactured by Teijin Chemicals Ltd.) | |
| Low molecular charge transport material having the following chemical structure 1 | 8 parts |
| Chemical structure 1 | |

-continued

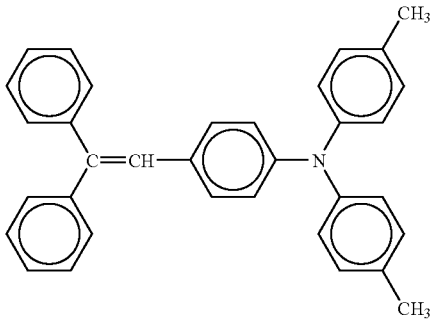

| | |
|---|---|
| Tetrahydrofuran | 200 parts |
| Liquid of application for protective layer | 10 parts |
| Bisphenol Z type polycarbonate (Zpolyca, viscosity average molecular weight Mv: 50,000, manufactured by Teijin Chemicals Ltd.) | |
| Low molecular charge transport material having the following chemical structure 2 | 7 parts |

Chemical structure 2

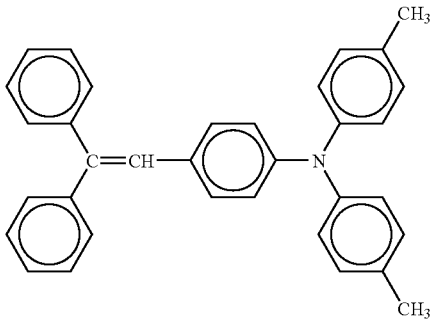

| | |
|---|---|
| Alumina filler (AA-02-AA-10, average primary diameter: 0.2 to 1.0 μm, specific resistance: (about 2.5 to 4) × $10^{12}$ Ωcm, manufactured by Sumitomo Chemical Co., Ltd.) | 5.3 parts |
| Tetrahydrofuran | 400 parts |
| Cyclohexanone | 200 parts |
| Dispersion helper (BYK-P104, manufactured by BYK Chemie Co. Ltd.) | 0.12 parts |

The surface free energy of this image bearing member is measured. The contact angles of diiodo methane, α-bromonaphthalene, glycerine, diethylene glycol are measured at 14 points having an interval of 20 mm to each other which start from 45 mm from the end of the image bearing member.

When the contact angles of diiodo methane, α-bromonaphthalene, glycerine, diethylene glycol are measured, the image bearing member is rotated so that the point measured for one of the solvents is not used for the other solvent while the distance between the point and the end of the image bearing member is kept the same. The surface free energy of the image bearing member based on the results of the measuring the contact angles of each solvent is from 50.2 to 50.7 mN/m. The difference between the maximum and the minimum of the surface free energy of the 14 points is from 0.0 to 0.2 mN/m.

This image bearing member is assembled into a tandem type color image forming apparatus (imagio Neo C325, manufactured by Ricoh Co., Ltd.). Images are formed using a toner having an average molecular weight of 6.4 μm which contains zinc stearate in an amount of 0.16% by weight. A polyurethane cleaning blade having a hardness of 70 on JIS-A, an impact resilience of 40 and a thickness of 2 mm is brought in contact with the image bearing member in counter direction. Forming two transfer media each of which has a chart having an average image area of 6% in which characters are uniformly arranged are formed is defined as one job and 70,000 images are formed. The average image area ratios H1 to H10 are obtained for the surface areas of the image bearing member divided into 10 in the direction perpendicular to the longitudinal direction thereof with an interval of 27 mm to each other. When there is any area whose corresponding average image area ratio is not greater than 1.3%, charging/irradiation/development is performed having a purpose other than image formation only for the area for a worth of two rotations of the image bearing member.

To be specific, when there is any area whose corresponding average image area ratio is not greater than 1.3%, 10 horizontal lines having 600 dpi and 4 dots with an interval of 32 dots to each other are developed for the area to supply a toner on the image bearing member every time a job is finished. Other than this, 15 horizontal lines having 600 dpi and 4 dots with an interval of 32 dots to each other for the area whose average image area ratio is not greater than 2% are developed per 500 sheets of image formation to supply a toner to the image bearing member.

The surface free energy of each image bearing member for black, yellow, cyan and magenta is measured. The average surface free energy of each image bearing member for black, yellow, cyan and magenta is 27.0, 26.4, 27.5 and 27.9 mN/m, respectively. The difference between the maximum and the minimum of the surface free energy of each image bearing member for black, yellow, cyan and magenta is 1.2, 1.6, 2.3 and 1.4 mN/m, respectively. Halftone images, solid images, lattice images for each color and landscape images photographed by a digital still camera are formed. The obtained images are all of high quality.

Example 6

30,000 images are formed in the same manner as in Example 5 except that the chart having an average image ratio of 6% is replaced with a chart having an average image ratio of about 10% in which the left half has an average image ratio of 20% and the right half contains characters with the average image ratio of 2%.

As in Example 5, the surface free energy of each image bearing member for black, yellow, cyan and magenta is measured. The average surface free energy of each image bearing member for black, yellow, cyan and magenta is 26.8, 27.8, 27.2 and 27.5 mN/m, respectively. The difference between the maximum and the minimum of the surface free energy of each image bearing member of black, yellow, cyan and magenta is 3.9, 2.7, 4.2 and 2.1 mN/m, respectively. Halftone images, solid images, lattice images for each color and landscape images photographed by a digital still camera are formed. The obtained images are all of high quality.

Comparative Example 3

Image formation is performed in the same manner as in Example 6 except that the charging/irradiation/development having a purpose other than image formation is not performed.

As in Example 6, the surface free energy of each image bearing member for black, yellow, cyan and magenta are measured. The average surface free energy of each image bearing member for black, yellow, cyan and magenta is 31.2, 28.8, 29.4 and 32.3 mN/m, respectively. The difference between the maximum and the minimum of the surface free energy of each image bearing member of black, yellow, cyan and magenta is 7.5, 4.1, 8.7 and 5.95 mN/m, respectively. Halftone images for each color are formed. The obtained black, cyan and magenta images have non-uniform density with streak patterns.

Example 7

Images are formed in the same manner as in Example 5 except that a toner to which zinc stearate is externally added in an amount of 0.15% by weight is used instead.

As in Example 5, the surface free energy of each image bearing member for black, yellow, cyan and magenta is measured after the image formation test. The average surface free energy of each image bearing member for black, yellow, cyan and magenta is 27.0, 27.5, 27.4 and 27.5 mN/m, respectively. The difference between the maximum and the minimum of the surface free energy of each image bearing member of black, yellow, cyan and magenta is 4.1, 3.3, 2.9 and 1.8 mN/m, respectively. Halftone images, solid images, lattice images for each color and landscape images photographed by a digital still camera are formed. The obtained images are all of high quality.

Example 8

An image formation test is performed in the same manner as in Example 7 except that the chart used has image date on its left half and characters on its right half as illustrated in FIG. 18. The average image area is 22% on the left half and 2% on the right half. The average image area of the entire charge is about 10%. The number of images formed is 50,000.

As in Example 7, the surface free energy of each image bearing member for black, yellow, cyan and magenta are measured after the image formation test. The average surface free energy of each image bearing member for black, yellow, cyan and magenta is 27.7, 28.8, 28.3 and 27.4 mN/m, respectively. The difference between the maximum and the minimum of the surface free energy of each image bearing member of black, yellow, cyan and magenta is 2.9, 3.5, 3.3 and 4.0 mN/m, respectively. Halftone images solid images, lattice images for each color and landscape images photographed by a digital still camera are formed. The obtained images are all of high quality.

Comparative Example 4

Image formation is performed in the same manner as in Example 8 except that the charging/irradiation/development having a purpose other than image formation is not performed. The number of images formed is 10,000.

The surface free energy of each image bearing member for black, yellow, cyan and magenta are measured.

The average surface free energy of each image bearing member for black, yellow, cyan and magenta is 34.5, 28.0, 29.3 and 33.5 mN/m, respectively. The difference between the maximum and the minimum of the surface free energy of each image bearing member of black, yellow, cyan and magenta is 12.1, 9.3, 15.2 and 6.1 mN/m, respectively. Halftone images for each color are formed. The obtained black, yellow, cyan and magenta and images have non-uniform density with streak patterns.

As seen above, according to the present invention, an image forming apparatus which can form quality images and has a high durability and a process cartridge detachably attached thereto are provided.

This document claims priority and contains subject matter related to Japanese Patent Applications Nos. 2005-158449 and 2005-157090, filed on May 31, 2005, and May 30, 2005, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member having a surface free energy of not less than 45 mN/m;

a charging device configured to charge the image bearing member;

an irradiating device configured to irradiate the image bearing member with light to form a latent electrostatic image on the image bearing member;

a developing device configured to develop the latent electrostatic image with a toner optionally comprising a lubricant material;

a transfer device configured to transfer the developed image to a transfer medium;

a cleaning device configured to clean a surface of the image bearing member; and optionally a lubricant material supplying device configured to supply a lubricant material to the surface of the image bearing member, wherein a lubricant material is supplied to the surface of the image bearing member by at least one of the toner and the lubricant material supplying device so that the surface free energy on average in an image formation area on the image bearing member is not greater than 32 mN/m while a difference between a maximum and a minimum of the surface free energy is not greater than 5 mN/m.

2. The image bearing member according to claim 1, wherein the surface free energy of the image bearing member is measured during image formation area by area each of which has a width of not greater than 50 mm in an orthogonal direction to a rotation direction of the image bearing member.

3. The image forming apparatus according to claim 1, wherein the lubricant material is supplied after the surface of the image bearing member is cleaned.

4. The image forming apparatus according to claim 3, wherein the image bearing member has a diameter of from 35 to 100 mm.

5. The image forming apparatus according to claim 1, wherein the lubricant material is a metal soap.

6. The image forming apparatus according to claim 1, wherein the surface free energy of the image bearing member is obtained from linear recurrence of contact angle data of the image bearing member and at least 4 kinds of liquids by a method of measuring the surface free energy of a solid in which a contact angle formed between the surface of the solid and a liquid whose surface free energy components are known is measured and the following relationship based on the Extended Fowkes Theory is used:

$$\gamma_L(1+\cos\theta)=2\sqrt{\gamma_S^a\gamma_L^a}+2\sqrt{\gamma_S^b\gamma_L^b}+2\sqrt{\gamma_S^c\gamma_L^c}$$

wherein $\gamma_L$ represents the surface free energy of the liquid represented by $\gamma^a_L+\gamma^b_L+\gamma^c_L$, $\gamma^a_L$ represents the dispersion component of the surface free energy of the liquid, $\gamma^b_L$ represents the dipole component thereof, $\gamma^c_L$ represents the hydrogen linking component thereof, $\gamma^a_S$ represents the dispersion component thereof the surface free energy of the solid, $\gamma^b_S$ represents the dipole component thereof, $\gamma^c_S$ represents the hydrogen linking component thereof, and $\theta$represents the contact angle.

7. The image forming apparatus according to claim 6, wherein the liquids for use in measuring the contact angle to obtain the surface free energy of the image bearing member are selected from the group consisting of methylene iodide, α-bromonaphthalene, diethylene glycol, glycerine, and formamides.

8. The image forming apparatus according to claim 1, further comprising an image information calculation device configured to calculate image information area by area each of which is formed by dividing the surface of an image bearing member in the direction perpendicular to the rotation direction of the image bearing member and wherein charging/irradiation/development having a purpose other than image formation is performed based on the image information.

9. The image forming apparatus according to claim 8, wherein each area has a width of not greater than 30 mm.

10. The image forming apparatus according to claim 8, wherein the image information calculation device calculates information on image area for a driving area of the surface of the image bearing member.

11. The image forming apparatus according to claim 8, wherein irradiation patterns are determined based on the image information for each area and irradiation and development are performed for a purpose other than image formation.

12. The image forming apparatus according to claim 8, wherein the charging/irradiation/development having a purpose other than image formation is performed per not greater than 2,000 transfer media.

13. The image forming apparatus according to claim 1, wherein an average particle diameter of the toner is not greater than 7 μm.

14. The image forming apparatus according to claim 1, having a highest image definition of not less than 1,000 dpi.

15. A process cartridge comprising:

an image bearing member having a surface free energy of not less than 45 mN/m, on which a latent electrostatic image can be formed;

at least one of a charging device configured to charge the image bearing member;

a developing device configured to develop the latent electrostatic image with a toner optionally comprising a lubricant material; and a cleaning device configured to clean a surface of the image bearing member; and optionally a lubricant material supplying device configured to supply a lubricant material to the surface of the image bearing member, wherein the lubricant material is supplied to the surface of the image bearing member by at least one of the toner and the lubricant material supplying device so that the surface free energy on average in an image formation area on the image bearing member is not greater than 32 mN/m while a difference between a maximum and a minimum of the surface free energy is not greater than 5 mN/m.

16. An image forming method comprising:

charging an image bearing member having a surface free energy of not less than 45 mN/m by a charging device;

irradiating the image bearing member with light to form a latent electrostatic image on the image bearing member by an irradiating device;

developing the latent electrostatic image with a toner optionally comprising a lubricant material by a developing device;

transferring the developed image to a transfer medium by a transfer device;

cleaning a surface of the image bearing member; and optionally supplying a lubricant material to the surface of the image bearing member by a lubricant material supplying device, wherein a lubricant material is supplied to the surface of the image bearing member by at least one of the toner and the lubricant material supplying device so that the surface free energy on average in an image formation area on the image bearing member is not greater than 32 mN/m while a difference between a maximum and a minimum of the surface free energy is not greater than 5 mN/m.

* * * * *